US012257473B2

(12) United States Patent
Yazdanshenas

(10) Patent No.: US 12,257,473 B2
(45) Date of Patent: Mar. 25, 2025

(54) WEIGHT PLATE RETENTION COLLAR WITH INTEGRATED CONTACT PATCHES

(71) Applicant: Alireza Yazdanshenas, Richardson, TX (US)

(72) Inventor: Alireza Yazdanshenas, Richardson, TX (US)

( * ) Notice: Subject to any disclaimer, the term of this patent is extended or adjusted under 35 U.S.C. 154(b) by 0 days.

(21) Appl. No.: 18/762,544

(22) Filed: Jul. 2, 2024

(65) Prior Publication Data

US 2024/0350856 A1 Oct. 24, 2024

Related U.S. Application Data

(63) Continuation-in-part of application No. 18/370,341, filed on Sep. 19, 2023, now Pat. No. 12,042,685.

(Continued)

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ..... A63B 21/0728; A63B 21/0724; A63B 21/075; A63B 21/4035; A63B 21/00061; A63B 21/00065; A63B 21/06; A63B 21/0726; A63B 21/4033; A63B 1/00; A63B 1/005; A63B 15/00; A63B 15/005; A63B 21/0004; A63B 21/00058; A63B 21/072; A63B 21/0722; A63B 21/078;

(Continued)

(56) References Cited

U.S. PATENT DOCUMENTS 5,295,934 A 3/1994 Collins
5,591,109 A * 1/1997 Strnad ..... A63B 21/0728 24/524

(Continued)

FOREIGN PATENT DOCUMENTS

WO 2020206508 A1 10/2020

OTHER PUBLICATIONS

Valor document (derived from: Valor Fitness Store, "Valor Fitness MB-OC Chrome Olympic Barbell Collars . . . " [online], Feb. 14, 2014 [retrieved on Sep. 30, 2024], Amazon, Retrieved from: https://www.amazon.com/Valor-Fitness-MB-OC-Olympic-Collars/dp/B00IGHHA5W) (Year: 2014).*

(Continued)

*Primary Examiner* — Joshua Lee
*Assistant Examiner* — Catrina A Letterman
(74) *Attorney, Agent, or Firm* — Bold IP PLLC; Houda El-Jarrah

(57) ABSTRACT

A barbell collar is described having a fastening element and one or more integrated, non-removable contact patches that are built into an interior side wall of the barbell collar. The barbell collar is circular shaped and does not have other parts other than the fastener element. The inner diameter of the cavity of the barbell collar is wide enough to accommodate a barbell inserted into the cavity. The combination of the integrated contact patches and the tip of the fastener element provides a secure hold and points of contact to the inserted barbell within the cavity of the barbell collar.

6 Claims, 20 Drawing Sheets

Related U.S. Application Data

(60) Provisional application No. 63/444,671, filed on Feb. 10, 2023.

(58) Field of Classification Search
CPC ..... A63B 21/0783; F16B 2/185; F16B 2/08; F16B 7/1418
See application file for complete search history.

(56) References Cited

U.S. PATENT DOCUMENTS

| | | | | |
|---|---|---|---|---|
| 6,007,268 | A | 12/1999 | Whittington | |
| 7,086,632 | B2 | 8/2006 | Lee | |
| 7,654,939 | B1 | 2/2010 | Lin | |
| 8,142,335 | B1 | 3/2012 | Leach et al. | |
| 9,084,913 | B2 | 7/2015 | Davies, III | |
| 9,095,743 | B2 | 8/2015 | Davies, III | |
| 9,522,296 | B2 | 12/2016 | Davies, III | |
| 9,925,407 | B2 | 3/2018 | Davies, III | |
| 10,022,582 | B2 | 7/2018 | Gangemi et al. | |
| 10,166,430 | B2 | 1/2019 | Gangemi et al. | |
| 10,188,894 | B2 | 1/2019 | Wang | |
| 10,737,132 | B2 * | 8/2020 | Gangemi | A63B 21/0724 |
| D905,805 | S * | 12/2020 | Muir | D21/694 |
| 11,052,276 | B1 | 7/2021 | Baker | |
| D979,677 | S * | 2/2023 | Liu | D21/694 |
| D1,023,190 | S * | 4/2024 | Coia | D8/394 |
| 2006/0160675 | A1 | 1/2006 | Brown | |
| 2006/0217244 | A1 * | 9/2006 | Hudson | A63B 21/0728 482/93 |
| 2011/0224053 | A1 | 9/2011 | Hamilton | |
| 2014/0256521 | A1 | 9/2014 | Davies, III | |
| 2016/0082304 | A1 * | 3/2016 | Behle | A63B 21/0728 482/107 |
| 2019/0046831 | A1 * | 2/2019 | Coury | A63B 21/4035 |
| 2020/0094100 | A1 * | 3/2020 | Garcia Castillo | A63B 21/0601 |
| 2021/0001166 | A1 * | 1/2021 | Stilson | A63B 21/0724 |
| 2022/0143453 | A1 * | 5/2022 | Martin | F16B 2/06 |
| 2022/0314060 | A1 | 10/2022 | Fogle | |
| 2022/0331643 | A1 * | 10/2022 | Kehlenbach | A63B 21/0724 |
| 2023/0071147 | A1 * | 3/2023 | Zhang | F16B 2/185 |

OTHER PUBLICATIONS

Rogue aluminum collars, https://www.roguefitness.com/rogue-usa-aluminum-collars?sku=AD0126-2&gclid=CjwKCAjwpJWoBhA8EiwAHZFzfuzn55B2vCakMdObiFD6wCT6fL1hZZCAOMIVMoZkU3rQI7e7aqGSyBoCfywQAvD_BwE, date accessed: Sep. 16, 2023.

ATX Competition Collars, https://samsfitness.com.au/barbells/barbell-collars-accessories/atx-v-50-400-collars, date accessed: Sep. 16, 2023.

SYQQ Stainless Steel Barbell Collar, https://www.ebay.com/itm/404198073191, date accessed: Sep. 16, 2023.

Rogue HG 2.0 Collars, https://www.roguefitness.com/rogue-hg-2-0-collars?sku=AD0114&gclid=CjwKCAjwpJWoBhA8EiwAHZFzfkJ2IVNi8xyqZMXGgVIAEfbuvlhcF_yjlpBL224zlgsW3-dG-nXQVhoCQu4QAvD_BwE, date accessed: Sep. 16, 2023.

Fox Claw Barbell Collar, https://www.amazon.com/YILE-Release-Stainless-Weightlifting-Training/dp/B07ZFDL9VH/ref=asc_df_B07ZFDL9VH/?tag=&linkCode=df0&hvadid=416691572875&hvpos=&hvnetw=g&hvrand=5244866408115800392&hvpone=&hvptwo=&hvqmt=&hvdev=c&hvdvcmdl=&hvlocint=&hvlocphy=9026832&hvtargid=pla-1063219927112&ref=&adgrpid=90730210941&th=1, date accessed: Sep. 16, 2023.

CAP Clip Collars, https://www.amazon.com/CAP-Barbell-Standard-1-Inch-Collars/dp/B0029F62LU/ref=sr_1_2?crid=38JX6UACO4IBN&keywords=coil+spring+barbell+collar&qid=1694896208&s=sporting-goods&sprefix=coil+spring+barbell+collar%2Csporting%2C116&sr=1-2, date accessed: Sep. 16, 2023.

* cited by examiner

WEIGHT PLATE RETENTION COLLAR WITH INTEGRATED CONTACT PATCHES

CROSS-REFERENCE TO RELATED APPLICATIONS

This continuation in part patent application claims priority to non-provisional patent application Ser. No. 18/370,341 which was filed on Sep. 19, 2023, which in turn claims priority to U.S. Provisional Patent Number 63/444,671, which was filed on Feb. 10, 2023, which is incorporated by reference in its entirety.

FIELD OF THE DISCLOSURE

The disclosure relates generally to a weight plate retention collar. In particular, the disclosure relates to a weight plate retention collar that includes a dynamic ability to absorb weight plate and barbel vibration and impact and shock.

BACKGROUND

Several types of weight plate retention collars exist to secure the weight plates to a barbell sports equipment in a reliable manner. However, historically the weight plate retention collars do not have the ability to mitigate vibration and impact of the weight plates and barbell during use. Thereby, the weight plate retention collars loosen, move, or fail in exercises that require multiple repetitions which is particularly problematic for weightlifters who have loaded barbells with heavy weights. The falling off of the weight plates due to the failure of the used barbell collars can cause injury to others and damage to surrounding objects or surfaces. Thus, a dynamic weight plate retention collar with the ability to mitigate vibration and impact of repeated use that is also serviceable and repairable is still needed in order to improve the function, longevity, and user experience when using a dynamic weight plate retention collar.

SUMMARY

The present description includes one or more non-limiting embodiments directed to a barbell body collar. The barbell body collar may comprise a circular body comprising a circular shaped cavity or annulus, the circular body further comprising a hole projecting through a top surface of the circular body. The barbell body collar may further comprise a first integrated contact patch formed onto a first interior side wall of the circular body and a second integrated contact patch formed onto a second interior side wall of the circular body. The first integrated contact patch and the second integrated contact patch each comprise a raised platform that is raised a distance above an interior side wall of the circular body. The first integrated contact patch and the second integrated contact patch are separated by a gap or a space on a lower interior surface of the circular body, wherein the gap is lower than the raised platform of the first integrated contact patch and the raised platform of the second integrated contact patch.

The apparatus may further include an adjustable fastener assembly comprising a fastener element having a handle, wherein the fastener element is insertable into the hole located through the top surface of the circular body, wherein a direction of the fastener element is manipulated by movement of the handle to move the fastener element in and out of the hole. Notably, the barbell body collar comprises at least three points of contact to contact an inserted barbell that is inserted into the cavity of the body. The at least three points of contact comprise a bottom surface of the fastener element, a top surface of the raised platform of the first integrated contact patch, and a top surface of the raised platform of the second integrated contact patch.

In a non-limiting embodiment, the fastener element is a set screw. The first integrated contact patch and the second integrated contact patch are raised a distance above a bottom or side edge of the circular body. The first integrated contact patch and the second integrated contact patch comprise a first sloped transition edge leading to a raised platform that in turn leads to a second sloped transition edge. In a non-limiting embodiment, the interior diameter of the circular body of the barbell body collar is approximately 2.05 inches wide. The outer diameter of the circular body of the barbell body collar is approximately 3.0 inches wide in a non-limiting embodiment.

Other aspects and advantages of the invention will be apparent from the following description and the appended claims.

BRIEF DESCRIPTION OF THE DRAWINGS

For a more complete understanding of this disclosure and its features, references are now made to the following description, taken in conjunction with the accompanying drawings in which.

DETAILED DESCRIPTION

The present description includes one or more non-limiting embodiments for a barbell collar having a number of superior advantages and features that allow the barbell collar to better handle heavier weight loads from a barbell, absorb shock and vibration, is serviceable with replaceable parts, among other notable advantages. Further details for the barbell are provided in accordance with the exemplary Figures further described below.

Figure 1A:
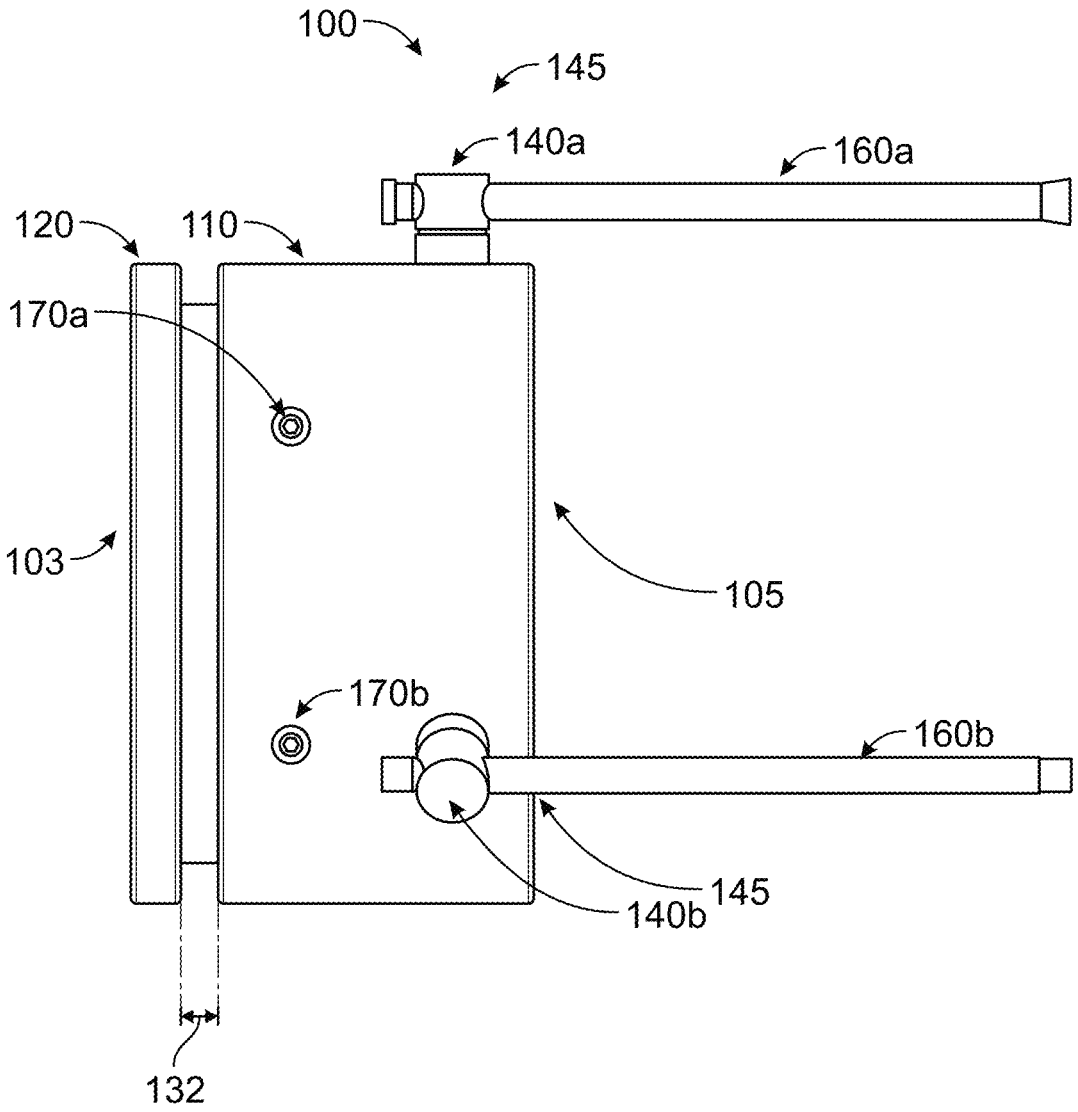
FIG. 1A is a side view of the barbell collar.

FIG. 1A shows a pictorial illustration of a barbell collar 100. It is noted that the term "barbell collar" is interchangeably referred to herein as a "dynamic weight plate retention collar" and "barbell clamp."

Figure 8:
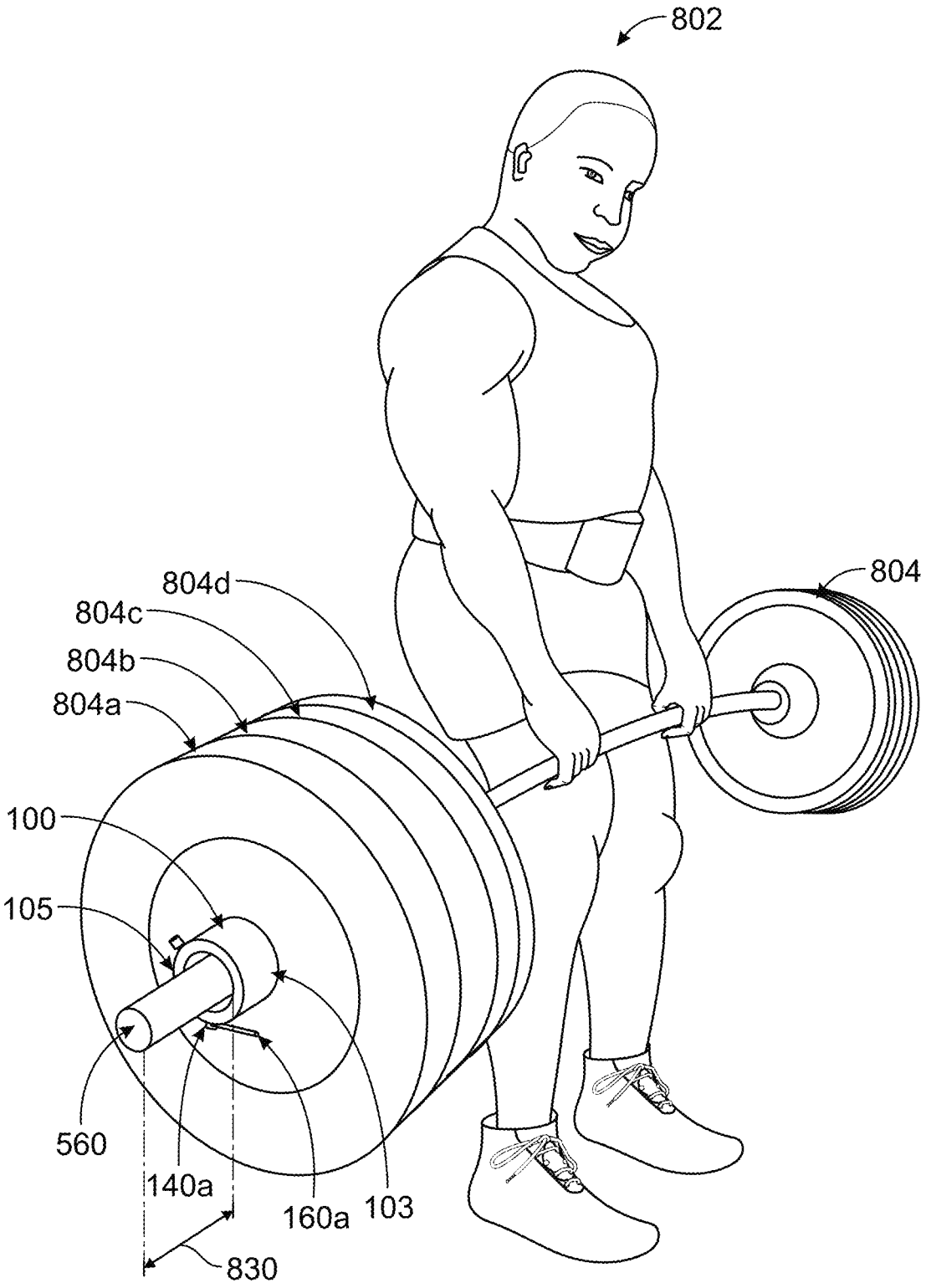
FIG. 8 is a pictorial illustration of an exemplary use of the dynamic weight plate retention collar on a barbell with weight plates supported on each side by the dynamic weight plate retention collars.

The barbell collar 100 is intended to be used to retain or hold one or more weight plates 804 in place, as shown in FIG. 8, on a barbell 560, so that the weight plates 804 do not slide off of the barbell 560 (or other functional equivalent of a weight lifting barbell or bar). The barbell collar 100 can be used on either side of the barbell 560 to hold as many weight plates 804 as desired by the user 802. Advantageously, the user 802 can slide the barbell collar 100 on in a forward or a reverse direction if needed to hold the weight plates 804, even with minimal distance 830 from the end of the barbell 560 as long as there is enough room for the contact patches 150*a*, 150*b*, 150*c* to clamp down onto the barbell 560.

A number of users 802 may benefit from using the barbell collar 100 as described herein in one or more non-limiting embodiments. Such users 802 may include, but are not limited to, power lifters, strong men and women, body builders, weightlifters, CROSSFIT athletes, and any weightlifters. The barbell collar 100 may be used in any type of venue, including, but not limited to, powerlifting gyms, body building gyms, weightlifting gyms, and/or any and all institutions or buildings or locations. This may include, but is not limited to, training facilities for amateurs, professionals, and/or students of any age or school level (e.g., high school and/or university). Advantageously, the barbell collars 100 can hold an extremely high load of weight plates 804, including in tests between 1000-2500 pounds of weight (or more).

Figure 1B:
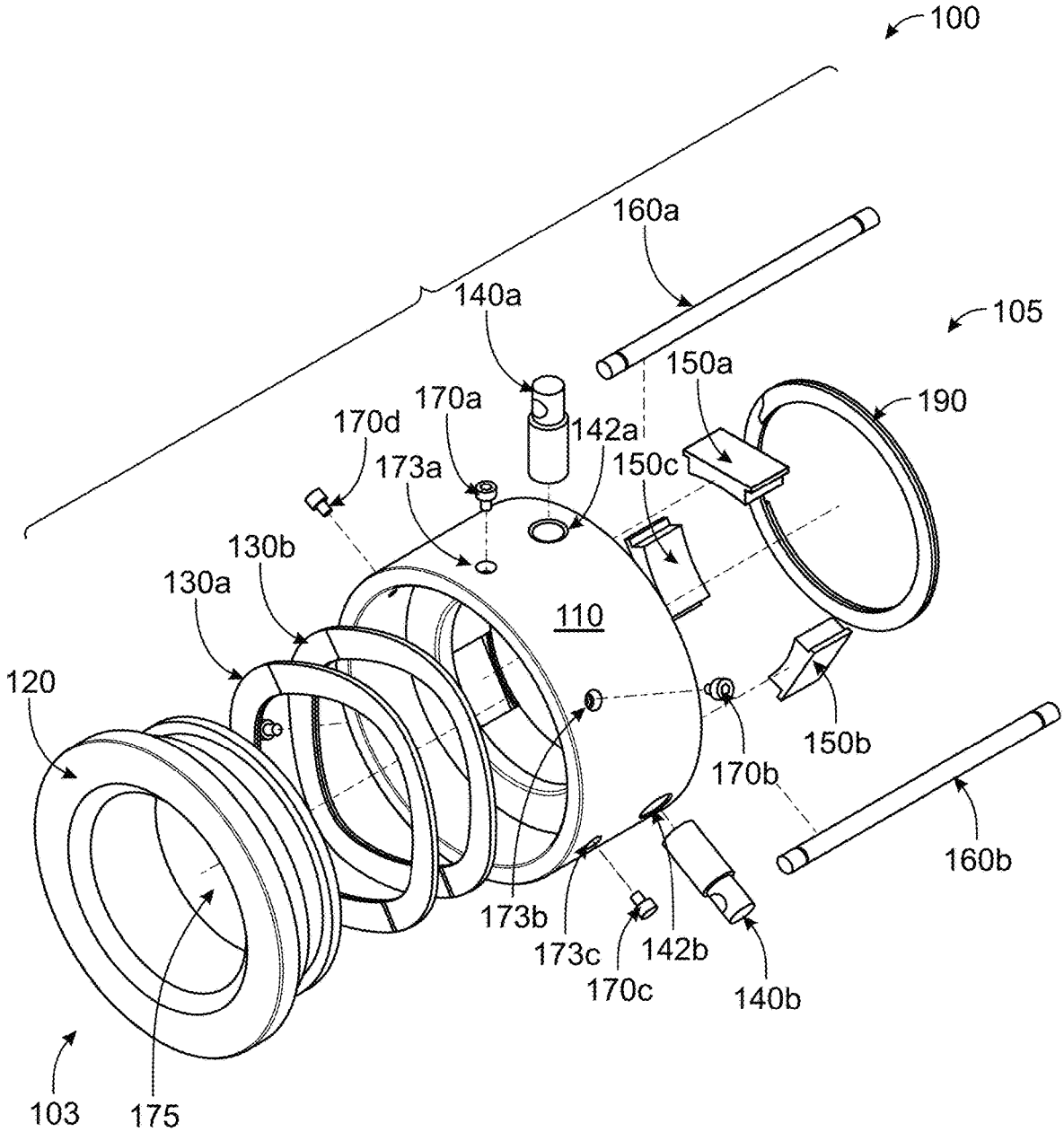
FIG. 1B is an exploded view of the barbell collar.

As noted above, the barbell collar 100 as described herein may interchangeably be referred to as "a dynamic weight plate retention collar." This may refer to the fact that the barbell collar 100 can dynamically absorb the shock transferred to the barbell collar 100 from the weight plates 804 on the barbell 560 as shown in FIG. 8. In a non-limiting embodiment, responsive to turning one or more adjustable fasteners 140 (as shown in FIG. 1B) with the torque pins 160 in one or more non-limiting embodiment, the contact patches 150*a*, 150*b* are adjustably moved forward to a closed position to contact a barbell 560 in order to hold the weight lifting plates 804 (e.g., as shown in FIG. 8) in place and prevent movement of the weight lifting plates 804 from side to side when positioned on a barbell 560. The barbell collar 100 bites down onto the metal or other material of the barbell 560 with enough force to hold the weight plates 804 in place on the barbell 560 for a weightlifting user 802 to proceed with weight lifting.

In a non-limiting embodiment, the type of adjustable fasteners 140 utilized as shown herein may be a turnbar screw having a sliding T bar handle (e.g., handle 160.) It is noted that other types of adjustable fasteners 140 may alternatively be used such as T-pins or other adjustable fasteners 140 that can be hand tightened by the user 802 from the exterior of the barbell collar 100.

FIG. 1B is an exploded view of the barbell collar 100 shown in FIG. 1A. The front side 103 of the barbell collar 100 and the back side 105 of the barbell collar 100 are marked in FIGS. 1A-1B. As shown in FIG. 8, in a non-limiting embodiment, one way of using the barbell collar 100 is to ensure that the rear side 105 of the barbell 100 is closest to and/or may contact directly a first weight plate 804 that the barbell collar 100 secures on a barbell 560, while the front side 103 of the barbell collar 100 is the furthest away from the first weight plate 804 that the barbell 100 secures on a barbell 560.

Figure 3A:
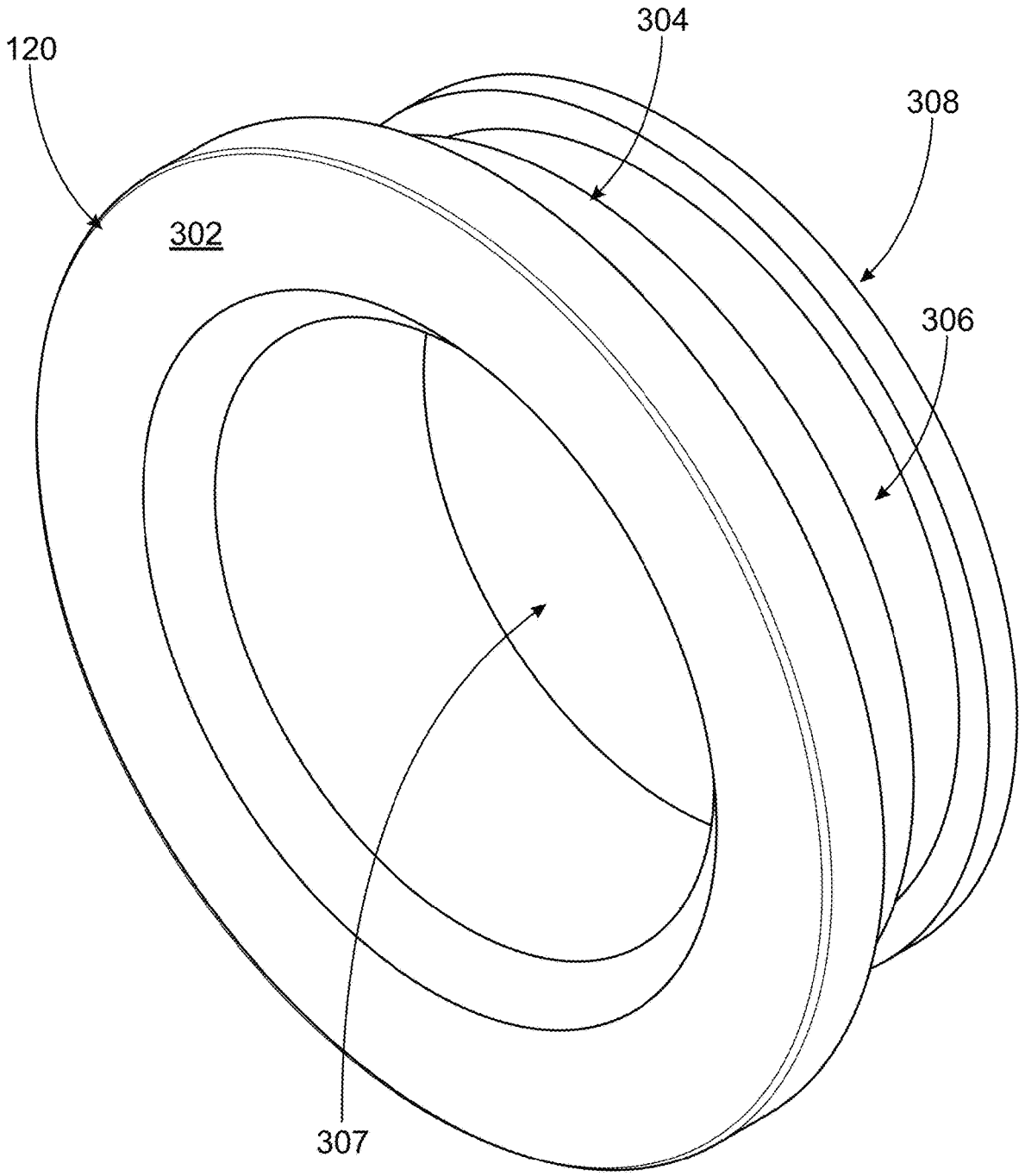
FIG. 3A is a front perspective view of the piston disk.
Figure 3B:
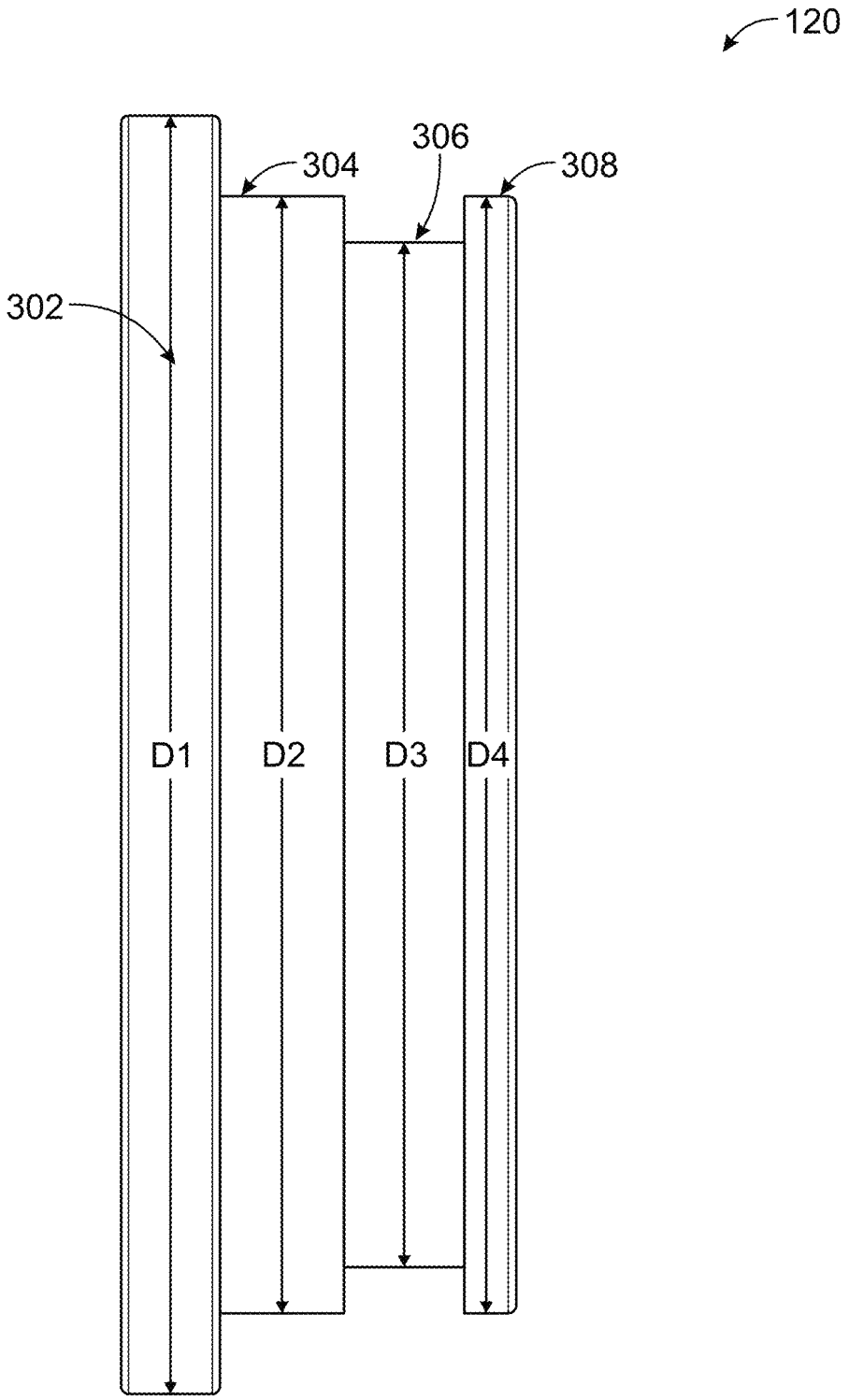
FIG. 3B is a side view of the piston disk.

At the front side 103 of the barbell 100, as shown in FIG. 1A and in FIG. 1B is a rotatable and dynamic piston disk 120. FIG. 3A and FIG. 3B show additional views of the dynamic, rotatable, and movable piston disk 120.

Next, as shown in the exploded view shown in FIG. 1B, there may be one or more energizers 130*a* and 130*b*. In a non-limiting embodiment, the term "energizer" as used herein may refer to a spring. In one non-limiting embodiment, the energizers 130*a* and 130*b* utilized for the barbell collar 100 are a particular type of springs known as radial springs or wave springs or Belleville springs. The radial springs or wave springs or Belleville springs provide a spring force that can dynamically move forward and back while held within the barbell collar 100. It is noted that any other type of springs may alternatively be used. Further, instead of springs, the energizers 130*a*-130*b* may be in the form of rubber rings. Additionally, it is noted that a single energizer 130 may be utilized rather than multiple energizers 130*a*-130*b* as shown in FIG. 1B and in other Figures.

Figure 2A:
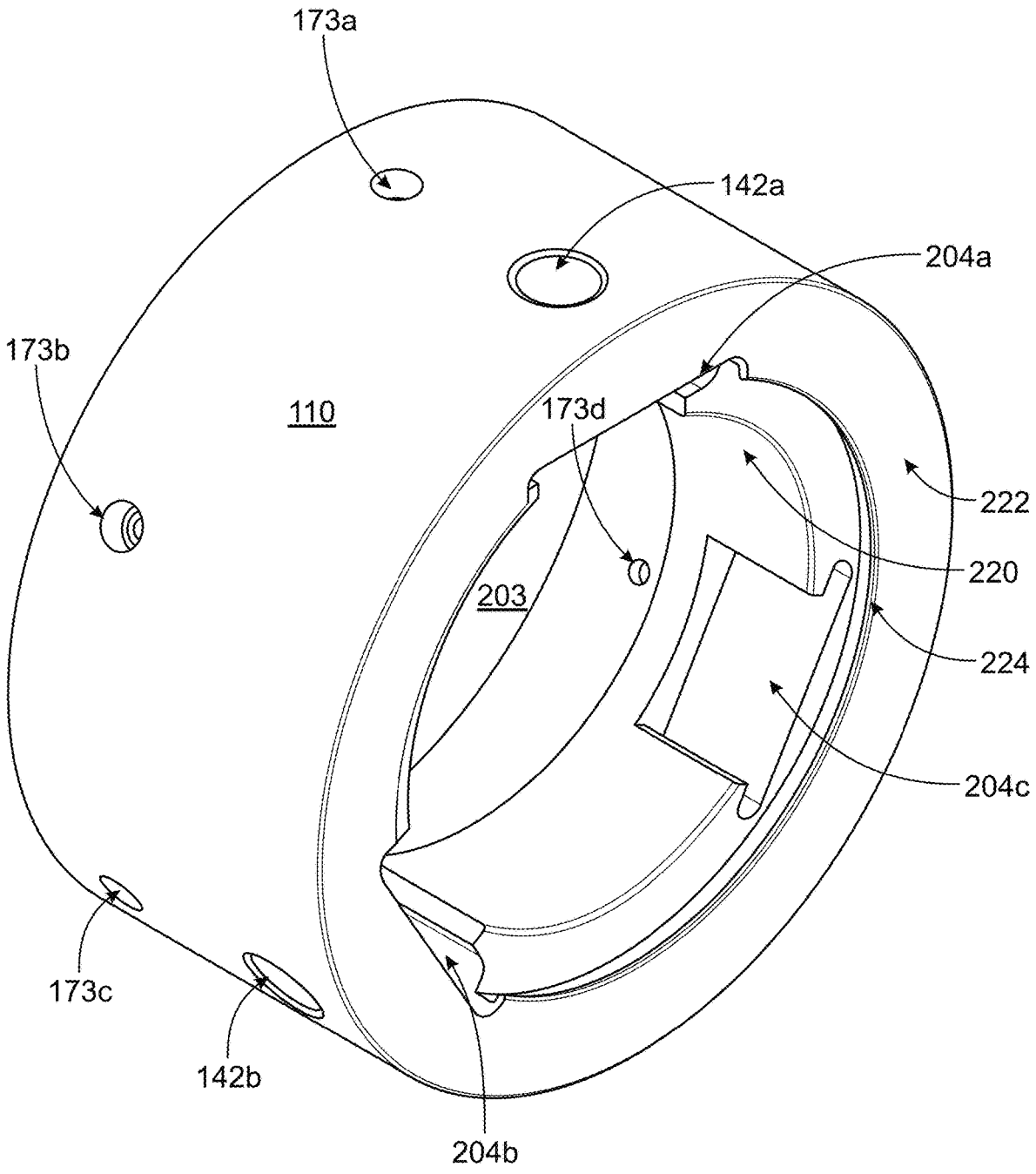
FIG. 2A is a rear perspective view of the body collar.
Figure 2B:
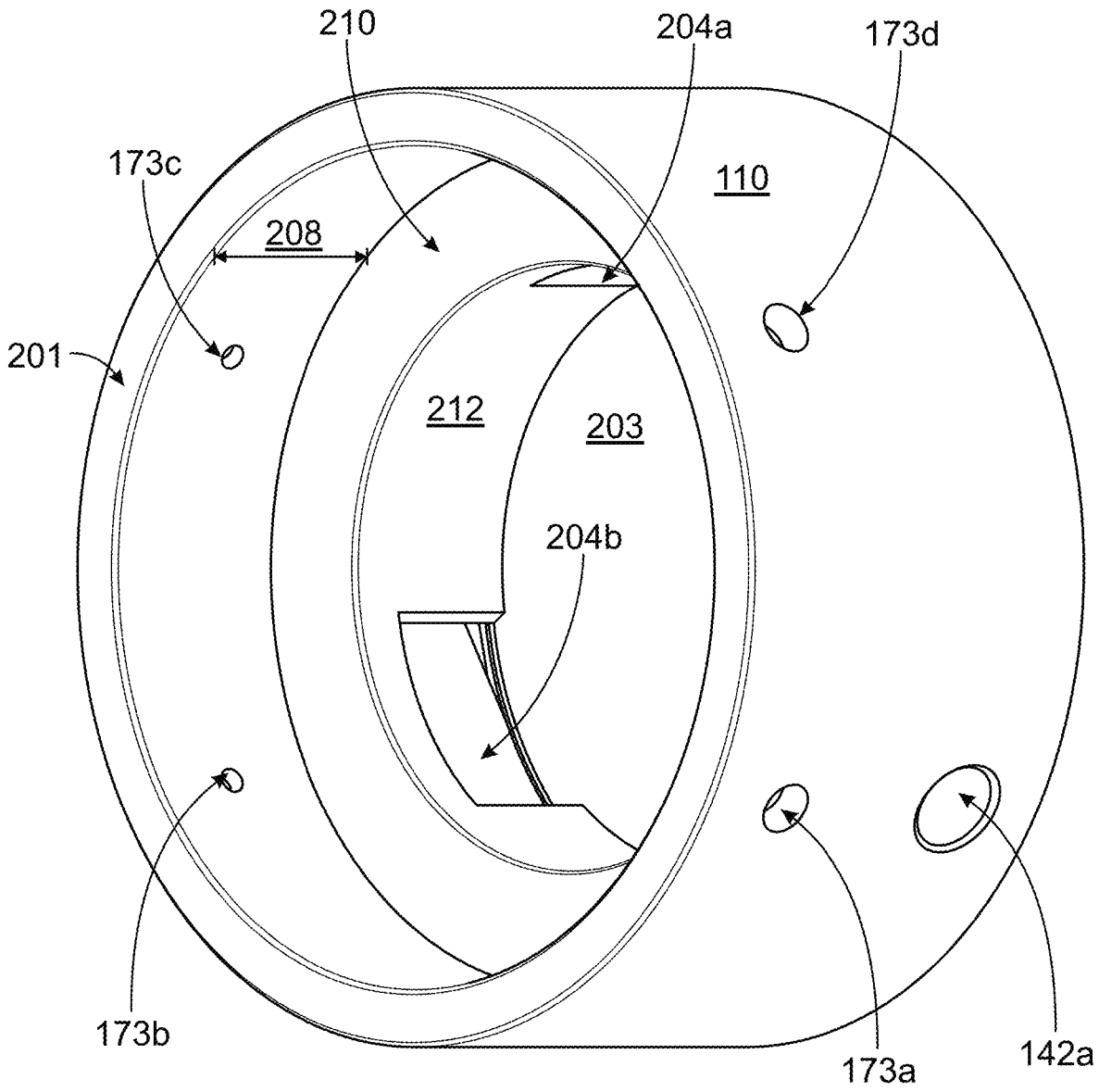
FIG. 2B is a front perspective view of the body collar.

The energizers 130*a*-130*b* are held in place between the rotatable and movable piston disk 120 and the body collar 110 as shown in the exploded view of FIG. 1B. here may be a separation 132 between the piston disk 120 and the front side 201 of the body collar 110 as shown in FIG. 1A. The body collar 110 has different elements included on different sides of the body collar 110. FIG. 2A and FIG. 2B show a rear side view and a front side view, respectively, of an exemplary body collar 110. The body collar 110 serves a number of functions in the barbell collar 100, including, but not limited having a recessed portion 210 to hold the combination of the piston disk 120 and the energizers 130*a* and 130*b* that need to be able to move into and out of the recessed portion 210 of the body collar over a limited range or distance responsive to the barbell collar 100 being tightened onto the barbell 560 or being untightened and released from contacting and/or gripping the barbell 560.

Figure 6A:
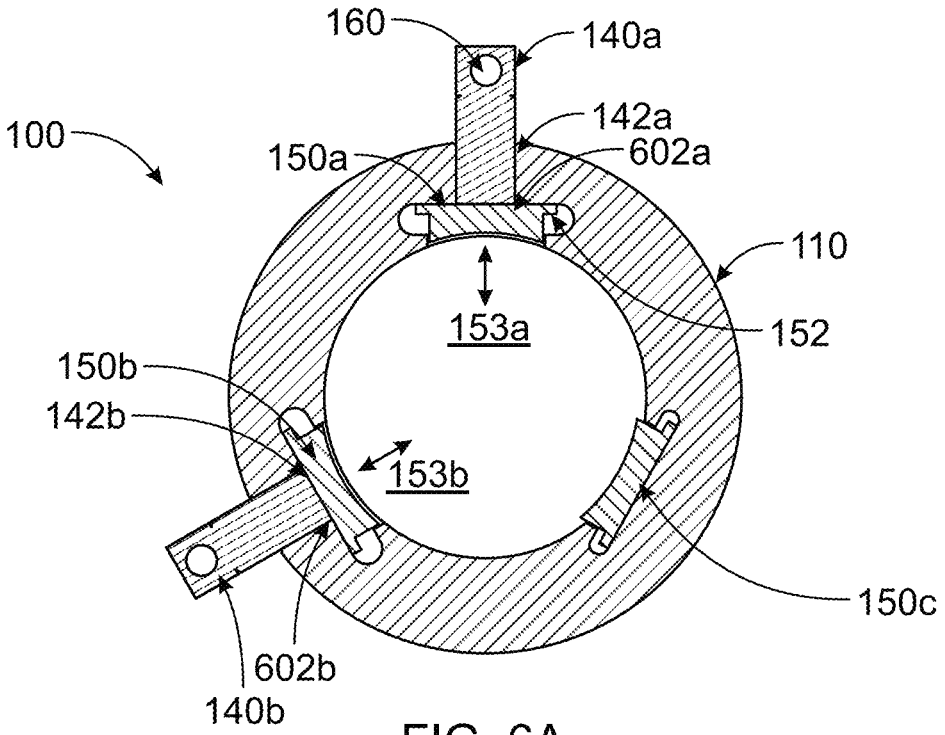
FIG. 6A is a cross-sectional view showing the barbell collar in the open position.
Figure 6B:
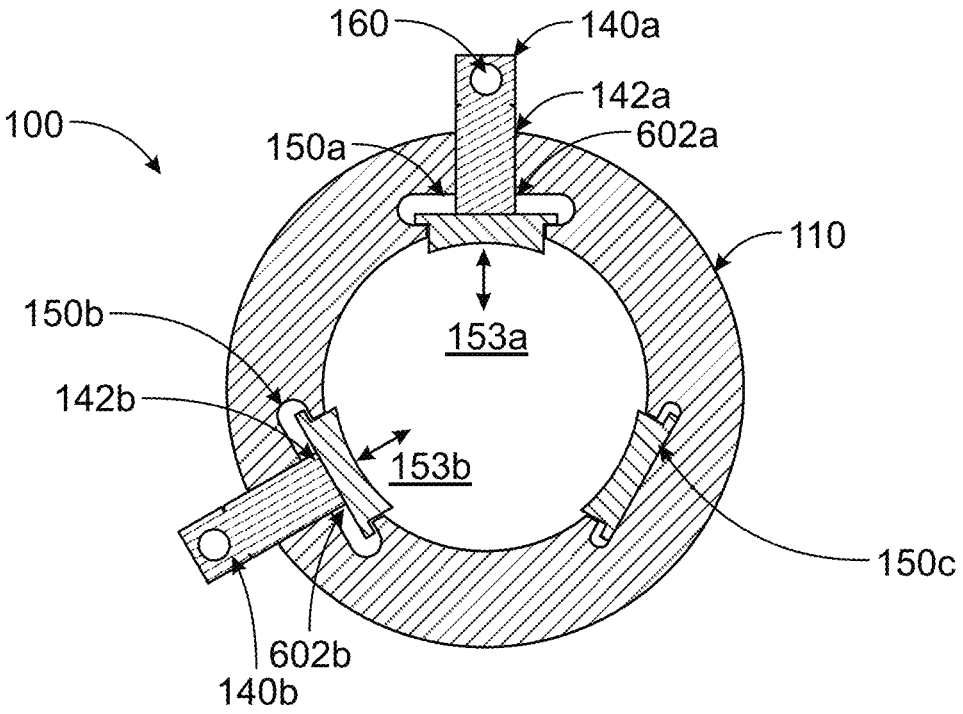
FIG. 6B is a cross-sectional view showing the barbell collar in the closed position.

As shown in FIG. 1B and in FIGS. 2A-2B, the body collar 110 further includes pockets 204 machined or otherwise integrated into the rear interior side walls 220, as shown in FIG. 2A, of the body collar 110. In a non-limiting embodiment, there may be at least three contact patches 150*a*, 150*b*, and 150*c* that are intended to dynamically move from an open position, as shown in FIG. 6A, to a closed position, as shown in FIG. 6B, repeatedly show that a user 802 can quickly and easily add or remove weight plates 804 to a barbell 560 and quickly and easily tighten and then untighten or release the barbell collar 100 as needed.

FIG. 1B and FIGS. 2A-2B shows a number of removable fasteners 170*a*, 170*b*, 170*c*, 170*d* inserted into dedicated fastener holes 173*a*, 173*b*, 173*c*, and 173*d*. These removable fasteners 170*a*-170*d* may be set screws that are either recessed within the fastener holes 173*a*-173*d* or flush with the entrance of the fastener holes 173*a*-173*d*.

Further, in a non-limiting embodiment, at least one adjustable fastener 145, as shown in FIG. 1A, may be utilized to manipulate a contact patch (e.g., 150*a* or 150*b*) held in place in a respective pocket 204*a* or 204*b*. In the non-limiting embodiment shown herein, two of the contact patches 150*a* and 150*b* are held in place in their respective pockets 204*a* and 204*b* integrated into the body collar 110. The adjustable fasteners 145, in a non-limiting embodiment, may comprise a rotatable and adjustable handle 160, such as handles 160*a* and 160*b*, shown in FIGS. 1A-1B, as well as a rotatable and adjustable fastener element 140*a* and 140*b*. Dedicated adjustable fastener holes 142*a* and 142*b*, as shown in FIGS. 1B-2B may be machined and/or otherwise integrated to extend through the body of the body collar 110 as shown in FIG. 1B and in FIGS. 2A-2B. In a non-limiting embodiment, the handles 160*a* and 160*b* are configured to either be fixed or to slide within a dedicated handle hole connecting the handles 160*a* and 160*b* to the adjustable fastener element 140*a* and 140*b*. In a non-limiting embodiment, the adjustable fastener element 140*a* and 140*b* may be a rotatable screw (e.g., turn bar screws with sliding T-bar handles) and/or a pin. In other non-limiting embodiments, the adjustable fasteners 145 may be T-shaped pins and/or other types of adjustable and removable pins that do not include a same appearance as shown in FIGS. 1A-8. Accordingly, alternatives types of adjustable fasteners 140 may be used in place of the handle 160 and adjustable fastener element 140 shown in FIGS. 1A-8. It is noted that in alternative embodiments, an alternative barbell collar 100 may have a single contact patch 150 and a single adjustable fastener 145.

As shown in FIG. 1B, the retention ring 190 may be a cylindrical ring that acts to close and cover the remaining previously included components of the barbell collar 100. The retention ring 190 may fit within a dedicated ring groove 224 machined into or otherwise integrated into a rear side of the barbell collar 100. The retention ring 100, in one or more non-limiting embodiments, may be made of, but is not limited to, a locking ring, a threaded connection, a press fit junction, a welded connection, a glued connection, or a combination thereof. In a non-limiting embodiment, the retention ring 190 may be a lock ring including but not limited to a SIPRA lock ring, although, any other type of ring or device may be used in other embodiments.

In a non-limiting embodiment, the piston disk 120, the body collar 110, and the retention ring 190 are generally cylindrically shaped and include their own bores or cavities that extend through a center or body of the piston disk 120, the body collar 110, and the retention ring 190. As shown in the exploded view of FIG. 1B, the one or more energizers 130*a*-130*b* may also be approximately circular shaped, although the wave springs shown in FIG. 1B do have elements that wave and curve and are not perfectly circular in shape in one or more non-limiting embodiments. In other embodiments, the wave springs 130*a*-130*b* may have a more circular shape. As shown in FIG. 1B, there may be a longer bore 175 that extends through the assembled components that are in horizontal alignment for the barbell clamp 100 when the barbell clamp 100 is assembled, which includes the piston disk 120, the energizers 130*a*-130*b*, the body collar 110, and the retention ring 190.

Turning to FIG. 2A and FIG. 2B, FIG. 2A provides a closer view of the rear side surface of the body collar 110 and FIG. 2B provides a closer view of the front side surface of the body collar 110. As shown in FIG. 2A, the body collar 110 is generally cylindrical with a number of integrated features. A plurality of pockets 204*a*-204*c* dedicated to receiving and holding the removable contact patches 150*a*-150*c* are machined or otherwise integrated into the interior side walls 220 of the body collar 110.

As shown in FIG. 2A, in a non-limiting embodiment, there may be three pockets 204*a*-204*c* dedicated to receiving three contacts 150*a*-150*c*. Further, the contact pockets 204*a*-204*c* may be machined or otherwise integrated into the body collar 110 by being positioned 120 degrees apart from each other. It is noted that there may be more than three pockets 204 in other non-limiting embodiments. In some barbell collars 100, there may also be only a single pocket 204 and a single contact patch 150.

The pockets 204*a*-204*c* may be purposefully positioned also so that at least one or more of the pockets (e.g., 204*a* and 204*b*) are positioned on an interior side wall 220 in alignment with a removable fastener hole 142*a* and 142*b* (e.g., as shown in FIG. 1B-2B). The removable fastener holes 142*a* and 142*b* extend all the way through from the outer shell or outer surface of the body collar 110 through to the interior side walls 220 of the body collar 110 so that the removable fasteners 140*a* and 140*b* that are removable insertable and/or rotatable (e.g., by the handles 160*a*-160*b*) in the fastener holes 142*a* and 142*b* may make contact when needed with the dynamic contacts 150*a* and 150*b*. In a non-limiting embodiment, two of the contacts are dynamic and are configured to move in and/or out within the pockets 204*a* and 204*b* in the direction of arrows 153*a* and 153*b* as shown in FIG. 6A and FIG. 6B. The remaining third contact 150*c* is a static contact patch and does not move in and/or out in the direction of arrows 153 and further does not include a dedicated fastener hole and/or removable fastener aligned with the third static contact patch 150*c*.

The adjustable fasteners 140*a* and 140*b* are designed to be adjusted by the user 802 from the outside or exterior of the barbell clamp 100. In a non-limiting embodiment, the adjustable fasteners 140*a* and 140*b* may be hand tightened by the user 802 either rotating in one direction to tighten the barbell collar 100, which initiates a series of steps and resulting actions. When the user 802 rotates both handles 160*a* and 160*b* to tighten the barbell collar 100, as a result, the adjustable fastener elements 140*a* and 140*b* rotate inwards within the dedicated fastener holes 142*a* and 142*b* and make contact with the dynamic contact patches 150*a* and 150*b* as shown in FIG. 6A and FIG. 6B. The points of contact 602*a*-602*b* between the adjustable fastener elements 140*a* and 140*b* and the dynamic contact patches 150*a* and 150*b* are shown in FIGS. 6A-6C. At this point of contact 602*a*-602*b*, the dynamic contact patches 150*a* and 150*b* can be manipulated to extend forward or retract backward in the direction of arrows 153*a*-153*b* either towards the barbell 560 or away from the barbell 560 (e.g., as shown in FIG. 5C and in FIGS. 6A-6B). As shown in FIGS. 6A-6B, contact patch 150*c* is static and does not advance forward or retract backward. The static contact patch 150*c* still functions to assist biting down on the exterior surface of the barbell 560 to further add additional grip and hold along with the retractable, dynamic contact patches 150*a* and 150*b* (e.g., as shown in FIG. 6C). Further, it is noted that the pockets 204*a*-204*b* are configured to allow movement within the pockets 204*a*-204*b* for both the adjustable fastener elements 140*a* and 140*b* and the dynamic contacts 150*a*-150*b*.

As shown in FIG. 2A, a rear surface 222 of the body collar 110 encircles the rear side of the body collar 110 and includes portions of the pockets 204*a*-204*c* in a non-limiting embodiment. The pockets 204*a*-204*c* for the contact patches 150*a*-150*c* are designed to extend partially in a radial direction into the side walls 220 of the body collar 110. It is noted that in a non-limiting embodiment, the body collar 110 may not include portions of the pockets 204*a*-204*c* in alternative embodiments.

FIG. 2B shows a front perspective view of the body collar 110. The front side of the body collar 110 includes a front surface 201. The front side 201 of the body collar 110 is configured for partially receiving and holding the dynamic piston element 120 as well as the one or more energizers 130*a*-130*b*. An interior ledge 210 is recessed within the body collar 110 away from the front surface 201 by a small distance 208 as shown in FIG. 2B. The front side/surface 201 of the body collar 110 and the interior ledge 210 acts as a stopping surface to stop the energizers 130*a*-130*b* and piston disk 120 from being pushed all the way through the bore 203 of the body collar 110. Further, the interior ledge 210 separates the front surface from the rear surface and/or the front half from the back half of the body collar 110 and the contact pockets 204*a*-204*c* and contact patches 150*a*-150*c*.

FIGS. 3A-3B show closer views of the piston disk 120 according to one or more non-limiting embodiments. The piston disk 120 may comprise four integrated rings or disks 302, 304, 306, and 308 as shown in FIGS. 3A-3B. As shown in FIG. 3A, the piston disk 120 includes a cavity 307 that extends through the cylindrical body of the piston disk 120 and through the interior of the four integrated disks 302, 204, 306, and 308. In a non-limiting embodiment, the diameter D1 of the first ring 302 may be wider than the diameter D2 of the second ring 304 which is interiorly positioned with respect to the first ring 302. Further, the diameter D2 of the second ring 304 may be wider than the diameter D3 of the third ring 306, as shown in FIG. 3B. In a non-limiting embodiment, the diameter D4 of the fourth ring 308 is the same in diameter as the diameter D2 of the second ring 304. Accordingly, the initial three rings 302, 304, 306 of the piston disk 120 reduce in diameter in a stepped fashion and then go up again with the fourth ring 308 for the piston disk 120. In a non-limiting embodiment, the energizers 130*a* and 130*b* are held in place and sandwiched between the body collar 110 and the piston disk ring 308 and do not go past piston disk ring 308 in a non-limiting embodiment. The energizers 130*a* and 130*b* have enough room to act as a spring and expand and retract in a spring like manner. FIG. 1B shows an expanded view of the barbell collar 100 showing how the energizers 130*a* and 130*b* are positioned in between the piston disk 120 and the body collar 110 of the barbell collar 100. Accordingly, the energizers 130*a* and 130*b* are held in place between the back surface of the piston disk 120 and the front of the body collar 110. Further, in a non-limiting embodiment, the energizers 130*a* and 130*b* may be held in place ahead of the recessed surface 210 on the body collar 110 as well in between the back of the piston disk 120 and the body collar 110 whether the energizers 130*a* and 130*b* are energized or in an unenergized position.

Figure 7A:
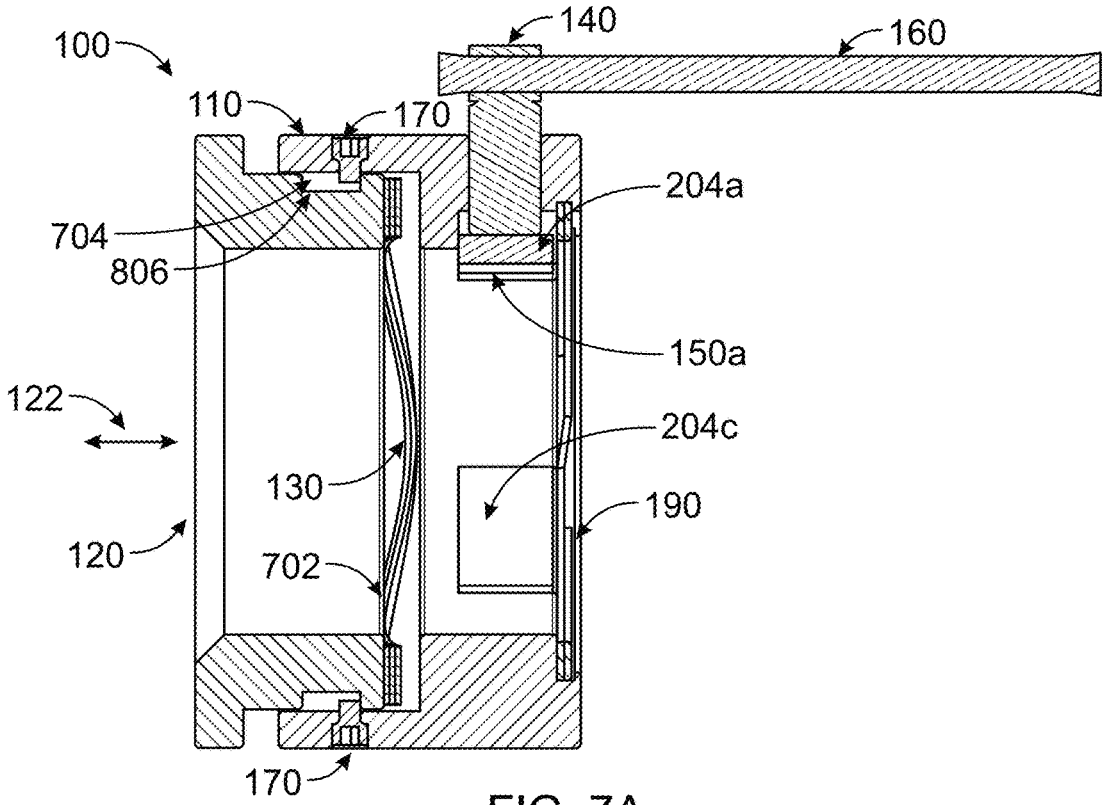
FIG. 7A is a cross-sectional view showing the dynamically energized piston mechanism in an unenergized position.
Figure 7B:
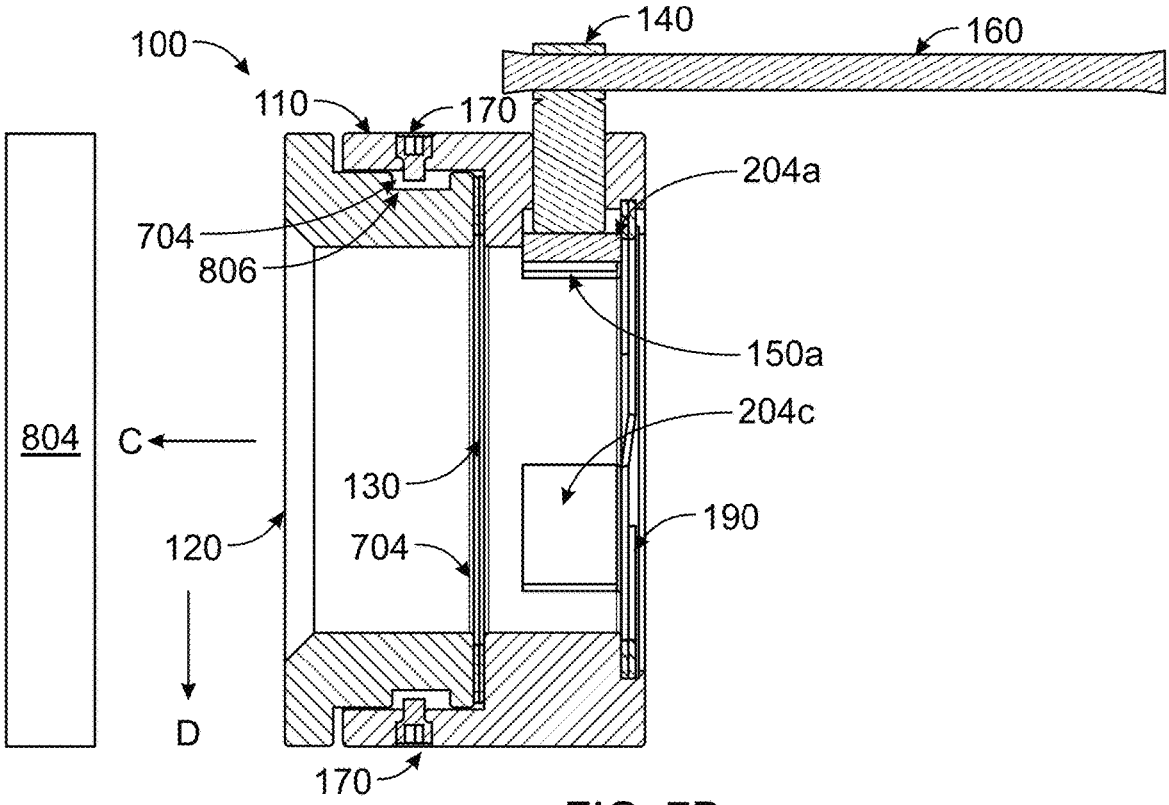
FIG. 7B is a cross-sectional view showing the dynamically energized piston mechanism in a fully energized position.

In a non-limiting embodiment, the piston disk 120 is rotatable and movable inwards and outwards towards the body collar 110 in the direction of arrow 122 as shown in FIG. 7A. The piston disk 120 acts to help absorb shock and vibration for the barbell collar 100. FIGS. 7A-7B show, in an example pictorial illustration, the dynamic vibration and impact absorption of the piston disk 120 mechanism. The piston disk 120 is able to move forward and backwards over a range 806 as shown in FIGS. 7A-7B and is further prevented from excessive movement by the protruding element of the retention fasteners 170 as shown in FIGS. 7A-7B. It is noted that the range 806 is the same as the length of D3 of the third ring 306 in one or more non-limiting embodiments.

The piston disk 120 is configured to contact directly against a given weight plate 804 when assembled on the barbell collar 100. However, it is also noted that if needed, the barbell collar 100 can be affixed onto the barbell 560 in a reverse or backwards position and the piston disk 120 may not touch the given weight plate 804 at that time.

The piston disk 120 has two mechanical degrees of freedom, including axial rotation and translation, both along the cylindrical axis of barbell collar 100 and the barbell 560. The provided axial rotational degree of freedom of piston disk 120 reduces load expectations on the barbell collar 100 by eliminating rotational loading or torque from the weight plates 804 to the contact patches 150*a*-150*c*. Further, any vibration and impact of the weight plates 804 along the cylindrical axis, through repetitive exercises, transfer from given weight plates 804 through piston disk 120, via its translational degree of freedom 122, to the included energizers 130*a*-130*b* (e.g., which may be in a non-limiting embodiment springs). As noted above, the energizers 130*a*-130*b* may include one or more components allowing for vibration and impact mitigation through a multitude of mechanical principals such as springs, friction, inertia, poisons ratio, viscosity, pressure, and electromagnetism.

Further, the FIG. 7A illustrates an example of how the one or more energizers 130*a*-130*b* may be in an unenergized position (their original shape). FIG. 7B illustrates an example of how the one or more energizers 130*a* and 130*b* may be in a fully energized position which may occur upon the user 802 dropping the barbell 560 loaded with weight plates 804 in the direction of arrow D down to the ground. Responsive to the force of the loaded barbell 560 contacting the ground surface in the direction of arrow D, it is noted that the energizers 130*a* and 130*b* may retract inwards in the direction of arrow C as shown in FIG. 7B into a fully energized position.

Notably, tightening of the adjustable fastener elements 140*a* and 140*b* causes a number of follow up reactions from other components of the barbell collar 100. Namely, the adjustable fastener elements 140*a* and 140*b* turn or rotate inwards and make contact with the contacts 150*a* and 150*b* (e.g., as shown in FIGS. 6A-6B). Next, the dynamic contact patches 150*a* and 150*b* push onto the barbell 560 itself (its outer diameter) and the user 802 can continue to tighten the adjustable fastener elements 140*a* and 140*b* individually or simultaneously until the desired level of tightness is reached thereby ensuring that the contact patches 150*a* and 150*b* are fully in contact and gripping the outer surface of the barbell 560. As noted above, the adjustable fastener elements 140*a* and 140*b* may be hand tightened from an exterior of the barbell collar 100 by either turning the handles 160 by hand or using another tool (e.g., wrench or other tool) to tighten (and/or release) the adjustable fastener elements 140*a* and 140*b*.

It is noted that the tightening of the adjustable fasteners 145 and the tightening (and/or turning in a particular direction) of the adjustable fastener elements 140*a* and 140*b* may be useful for causing the dynamic contact patches 150*a* and 150*b* to move forward (advance towards the barbell 560) or to retract away from the barbell 560 while held within their respective contact patches 204*a*, 204*b*. The act of adjusting the adjustable fasteners 145 to tighten and/or loosen the adjustable fasteners 145 may affect the contact patches 150*a* and 150*b* but may be separate from the independent movement of the piston disk 120. During tightening or loosening of the adjustable fasteners 145, the piston disk 120 and the springs/energizers 130 are not energized and are in their unenergized position as shown in FIG. 7A. The piston 120 is able to move forwards and back against the energizers 130*a* and 130*b* and may be stopped from moving forward by the recessed interior ledge 210. The piston 120 may move forward and back within the overall barbell collar 100 and may rotate responsive to receiving shock transferred from the weight plates 804 once the barbell 560 and the weight plates 804 are dropped to the ground in the direction of arrow D. This may occur because a weight lifter/user 802 will repeatedly drop the barbell 560 to the ground (e.g., in the direction of arrow D as shown in FIG. 7B) while lifting weights and/or exercising which will cause the weight plates 804 to shift and move. Advantageously, the barbell collar 100 includes the piston disk 120 and energizers 130 which are able to absorb that shock.

Figure 4:
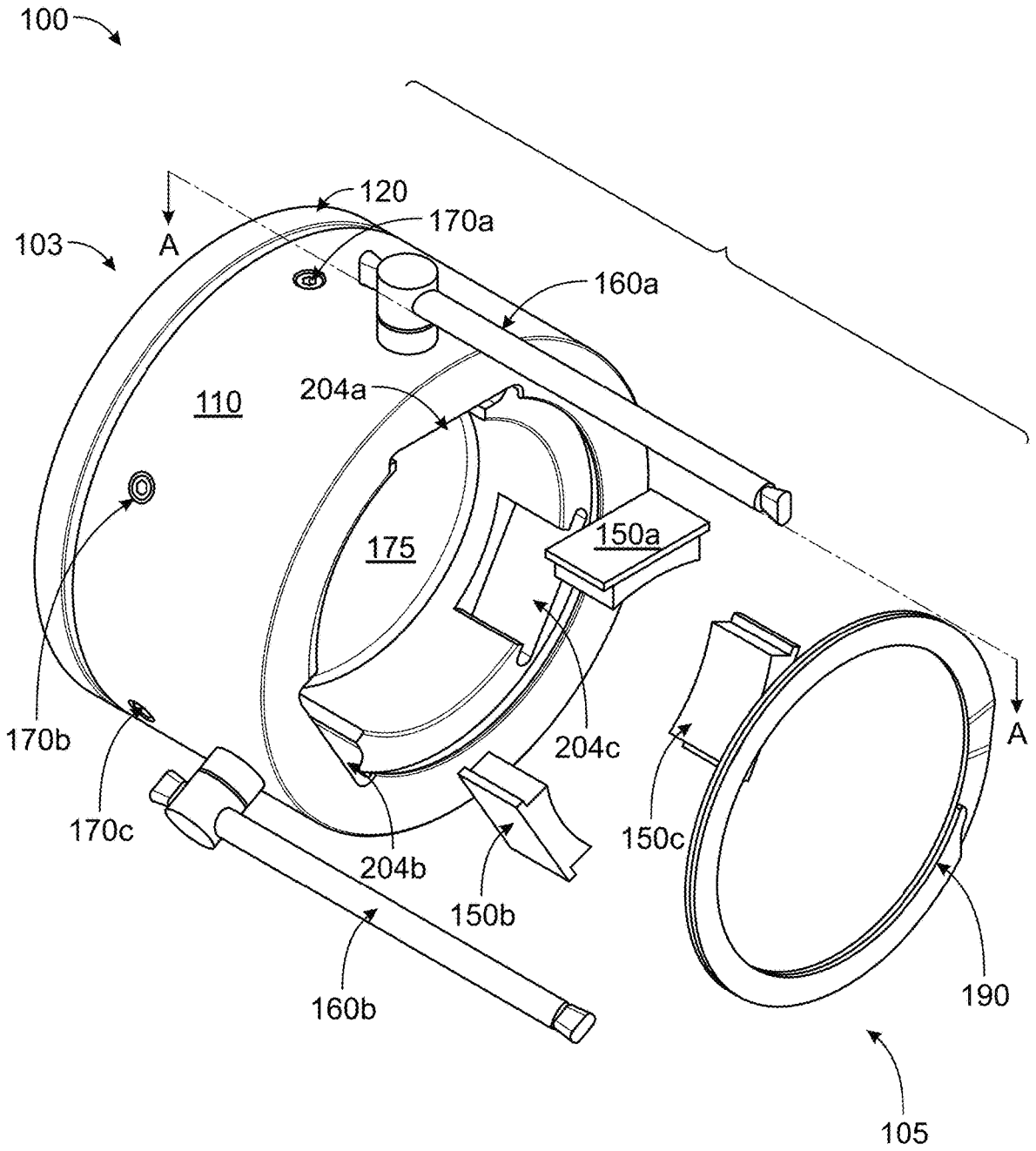
FIG. 4 is a rear exploded view of some of the components of the barbell.

FIG. 4 shows a partially exploded view of the barbell collar 100 and the contact patches 150*a*, 150*b*, and 150*c* and retention ring 190, which are located towards the rear side 105 of the barbell collar 100. It is noted that by removing the retention ring 190 from the back of the body collar 110, the user 802 may then slide out the contact patches 150*a*, 150*b*, 150*c* if it is needed to replace the contact patches 150*a*, 150*b*, and 150*c*, such as for example when they became worn and need to be replaced with newer contact patches 150. Notably, the contact patches 150*a*, 150*b*, 150*c* do not have fasteners attaching the contact patches 150*a*, 150*b*, 150*c* to the body collar 110. The contact patches 150*a*, 150*b*, and 150*c* do not have to be unfastened or disassembled from the body collar 110 meaning that it is not required to unscrew or unfasten the contact patches 150*a*, 150*b*, and 150*c* or take each one apart from the location they are each individually held in the contact pockets 204*a*, 204*b*, and 204*c*. The retention ring 190 may be easily removed manually using one's hands or a tool to pop the retention ring 190 off of the back of the body collar 110. Once the retention ring 190 is removed, the user may manually pull out each contact patch 150*a*, 150*b*, and 150*c* from its respective contact pocket 204*a*, 204*b*, and 204*c* by sliding out the contact patch 150*a*, 150*b*, and 150*c*.

This may be beneficial so that the user can easily replace any worn out contact patches 150*a*, 150*b*, and 150*c* with new, unused contact patches 150 that can be then slid into place or pushed into place within each respective contact pocket 204*a*, 204*b*, 204*c*. The contact pockets 204*a*, 204*b*, and 204*c* are uniquely sized and formed to closely fit the dimensions of the contact patches 150*a*, 150*b*, and 150*c* such that the contact patches 150*a*, 150*b*, and 150*c* are able to move as desired (e.g. dynamic contact patch 150*a* and 150*b*) or stay put as desired (e.g. stationary contact patch 150*c*). The retention of the contact pads 150 is assisted by retention ring 190. Retention ring 190 may assist in the retention of the contact pads 150 by interference fit or friction fit against body collar 110. Afterwards, the user 802 may replace the retention ring 190 to hold the new and/or replaced contact patches 150 in place within their designated pockets 204*a*, 204*b*, 204*c* within the body collar 110. Notably, neither the contact pockets 204*a*, 204*b*, 204*c*, nor the contact patches 150*a*, 150*b*, and 150*c* require a user to use a screwdriver or drill or another tool to disassemble or detach or remove either the contact pockets 204 or the contact patches 150 from the body collar 110 in order to replace and/or service the contact patches 150.

The overall design intent of the barbell collar 100 allows for the removal and replacement of the contact pads 150 and quick servicing of the contact pads 150, without having to interfere or dissemble any major components of the barbell collar 100. The quick and easy removal and replacement of the contact pads 150 is a key utility provided by the strategic design intent of the barbell collar. FIG. 4 shows that the ability to swap out and/or remove/replace the contact pads without having to extensively disassemble the barbell collar 100 which is not available in existing barbell collars 100.

Figure 5A:
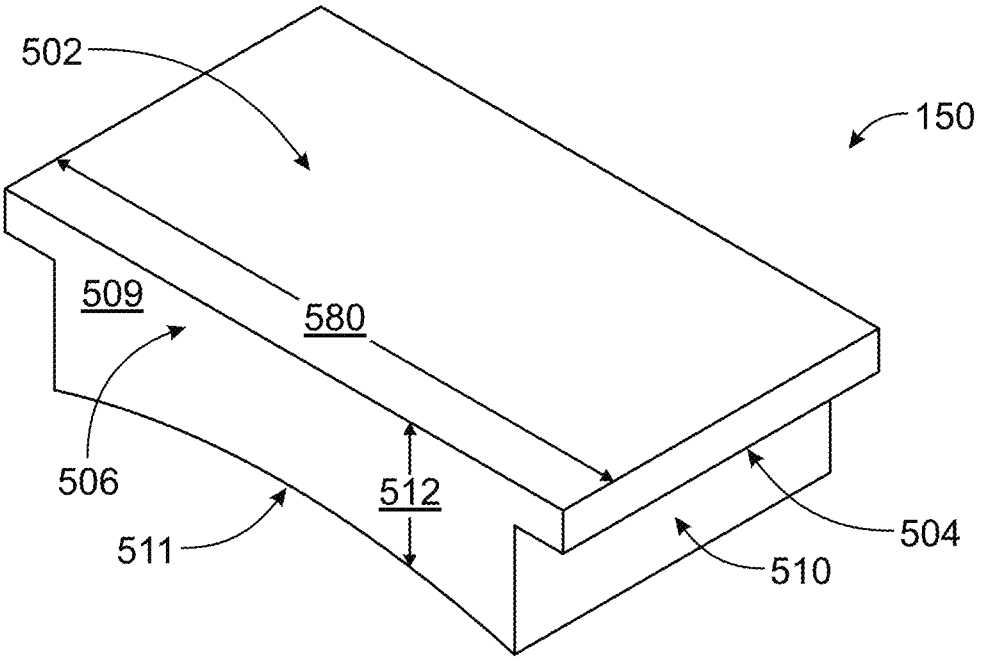
FIG. 5A is a top perspective view of a contact patch.
Figure 5B:
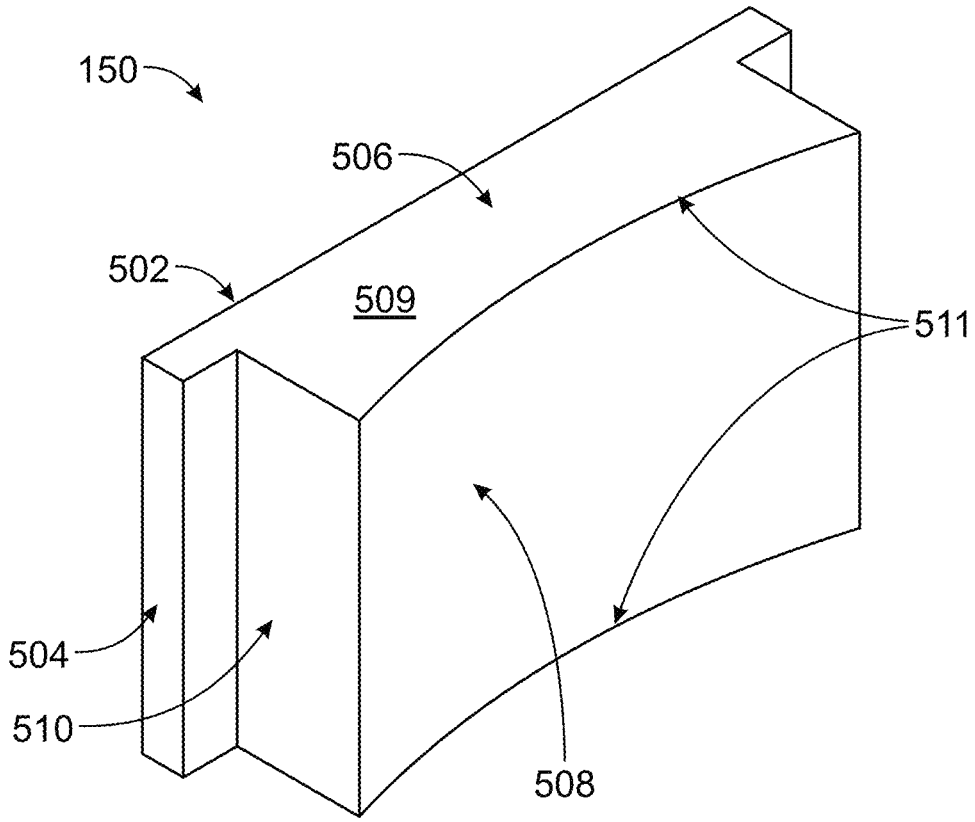
FIG. 5B is a bottom perspective view of the contact patch shown in FIG. 5A.
Figure 5C:
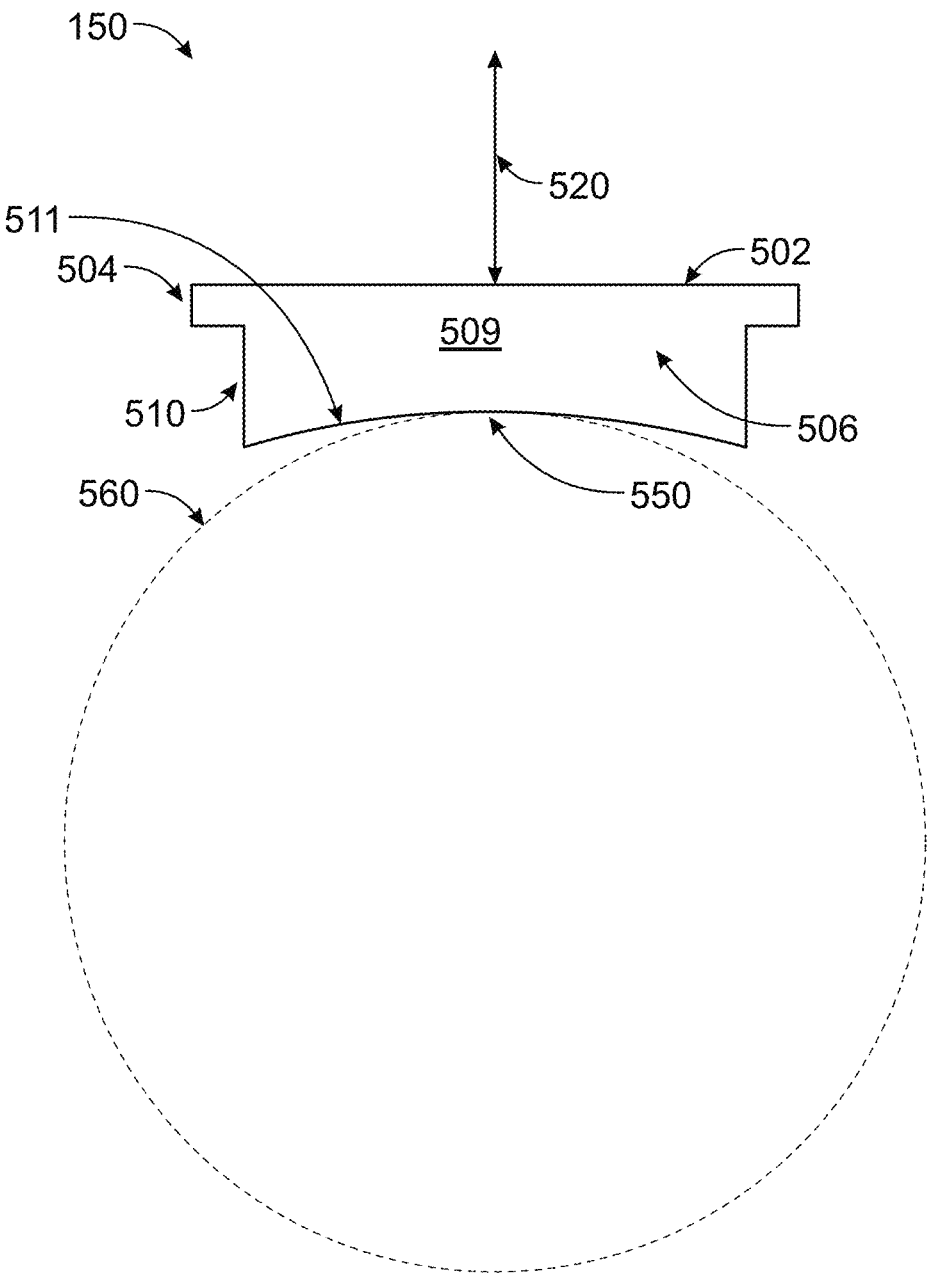
FIG. 5C is a pictorial illustration of the contact patch in contact with an exemplary barbell.
Figure 6C:
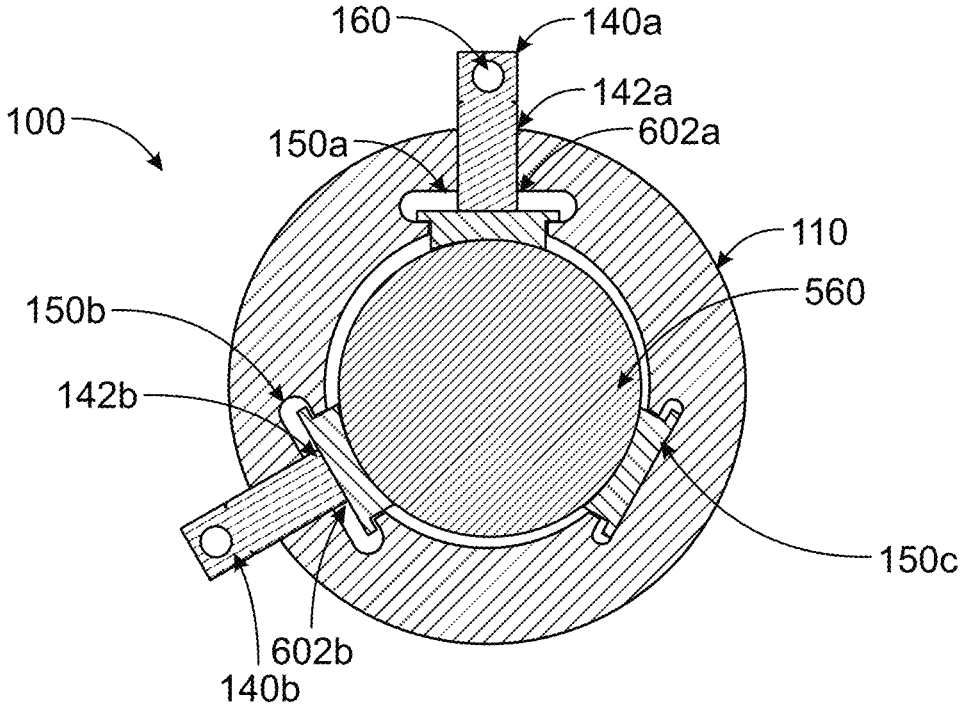
FIG. 6C is a cross-sectional view showing the barbell collar in the closed position with the contact patches in contact with the exemplary barbell inserted within the barbell collar.

FIGS. 5A-5C provide additional details related to an exemplary shape and design of the contact patches 150*a*, 150*b*, and 150*c* according to one or more non-limiting embodiments. The contact patches 150 overall act as a load bearing surface to receive the load from the adjustable fasteners 140*a*, 140*b* as well as able to grip down onto the outer surface of the barbell 560 and provide a means for the body collar 110 and the barbell collar 100 as a whole to clamp down onto the barbell 560. The contact patches 150*a*-150*c* have one or more beneficial features. In a non-limiting embodiment, the contact patches 150*a*-150*c* include a load surface 502 that receives the clamping load applied from the barbell collar 100. The load surface 502 may have optimized surface properties, such as, but not limited to, having a smooth or rough surface as needed to enhance the efficiency of a given clamping load. The load surface 502 is intended to make contact with the bottom surface of the adjustable fasteners 140*a*, 140*b* and/or the pockets 204 of the body collar 110 in the case of the static contact patch 150*c* (e.g., as shown in FIG. 2B).

In some embodiments, the load surface 502 may be concave shaped or alternatively may be convex shaped. The load surface 502 of each contact patch 150 may be connected to a bottom element 506 that protrudes down and away from the load surface 502 of each contact patch 150.

The contact patches 150 may have side surfaces 509 with edges 511 and may span the distance 512 beneath the top load bearing surface 502. It is noted that distance 512 refers to any point along the side surfaces 509 between the top surface 502 and the edge 511. In a non-limiting embodiment, the lowermost surfaces 508 and/or edges 511 may be concave shaped as shown or may alternatively be straight or curved or convex shaped. The contact patches 150 include a retaining side 504 on each side of the contact patches 150. Beneath the retaining side 504 there is a retraction side 510 on each side of the contact patches 150. Side surfaces 509 of the contact patches 150 joins with the bottom edges 511. The bottom surface 508 of the contact patches 150 is shown in FIG. 5B. The bottom surface 508 plays a significant role in the barbell collar 100 because the bottom surface 508 of the contact patches 150*a*, 150*b*, and 150*c* makes contact with the barbell 560. This bottom surface 508 can be optimized in concavity, convexity, surface roughness or surface treatment to optimize contact against the barbell 560.

In a non-limiting embodiment, the top load bearing surface 502 has a wider width 580 than the bottom area (including retraction side 510) of the contact patches. FIG. 5B further shows the difference in width between the top load bearing surface 502 and the lower surface of the contact patches 150.

FIG. 5C shows an example of the contact patch 150 contacting an exemplary barbell 560. As shown in FIG. 5C, the top load bearing surface 502 is intended to receive the load 520 as shown in exemplary form in FIG. 5C as applied from the adjustable fastener elements 140 (e.g., adjustable fasteners 140*a*, 140*b*).

In a non-limiting embodiment, the barbell collar 100 includes at least three contact patches 150*a*, 150*b*, and 150*c*. There may be two dynamic contact patches 150*a* and 150*b* and a static contact patch 150*c* as shown in FIG. 6A and in FIG. 6B. The dynamic contact patches 150*a*, 150*b* can be retracted using the adjustable fasteners 140*a*, 140*b* to their open retracted position shown in FIG. 6A. The dynamic contact patches 150*a*, 150*b* can be activated to be pushed down onto the barbell 560 when the adjustable fasteners 140*a*, 140*b* are activated by the user 802 (either by hand or using a tool or using another mechanism) as shown in FIG. 8. FIG. 6C shows an exemplary barbell 560 inserted into the interior cavity 203 (e.g., as shown in FIG. 2A) of the body collar 110 with the three contact patches 150*a*, 150*b*, and 150*c* contacting the exterior surfaces of the barbell 560.

It is noted that in other non-limiting embodiments, the barbell collar 100 may have only one contact patch 150 or two contact patch 150. In such cases, the dimensions of the contact patch 150 may be adjusted to cover a greater surface area of the barbell 560 than the size of the contact patches 150*a*-150*c* shown in FIGS. 1A-8, however, the overall appearance and form and structure of the contact patch 150 used (even if less than three or great than three are utilized) remains the same as shown in FIGS. 1A-8 and remains in particular as shown in FIGS. 5A-5C.

The dynamic contact patches 150*a* and 150*b* can be tightened to a level of tightness as needed using the adjustable fasteners 140 and handles 160 (in a non-limiting embodiment) to clamp down onto the barbell 560 and then can be loosened using the adjustable fasteners 140 and handles 160. Notably, the static contact patch 150*c* functions to prevent excessive wear to the interior surfaces 220 of the body collar 110.

One of the reasons that the body collar 110 and the barbell collar 100 is serviceable is that the three contact patches 150*a*, 150*b*, and 150*c* are all meant to be replaceable or serviceable with newer contact patches 150*a*, 150*b*, and 150*c*. This is one of the advantages over existing, conventional barbell collars. With existing, conventional barbell collars, their interior surfaces are regularly worn out from constant friction and contact with the barbell 560 holding heavy weight plates 804 and the user cannot repair the interior surfaces. Rather, the user has to purchase an entirely new barbell collar. With the barbell collar 100 shown in FIGS. 1-8 and as shown specifically in FIG. 4, the user 802 can replace any or all of the contact patches 150*a*-150*c*, including the dynamic contact patches 150*a*, 150*b* and static contact patch 150*c*.

FIG. 7A shows a cross-sectional view of barbell collar 100 with the springs/energizers 130 in an unenergized position. FIG. 7B shows a cross-sectional view of a barbell collar 100 with the springs/energizers 130 in their energized position. It is noted that when each barbell collar 100 is clamped down onto the barbell 560 to hold the weight plates 804 on either side of the barbell collars 100, the user 802 tightens the adjustable fasteners 140*a*, 140*b* (or only one of the above or more than the above fasteners 140*a* in alternative embodiments). During the tightening via the dynamic, retractable, and removable adjustable fasteners 140*a*, 140*b* the springs/energizers 130 may initially remain in their unenergized position shown in FIG. 7A. However, if the barbell 560 is dropped to the floor in the direction of arrow D (as shown in FIG. 7B) with the weights 804 held onto the barbell 560 by the tightened barbell collars 100, the springs/energizers move or shift into their energized position shown in FIG. 7B to help absorb the shock. As further shown in FIGS. 7A-7B, the piston disk 120 and energizers 130*a*-130*b* can have a stroke distance 806 as a parameter of operation.

The barbell collar 100 is advantageously configured such that the piston disk 120 is able to freely rotate even while the body collar 110 remains static and does not rotate. The barbell collar 100 is better able than conventional barbell collars to absorb the shock applied from the weight plates 804 on the barbell 560 due to the fact that the piston disk 120 can freely rotate ahead of the body collar 110 even though the body collar 110 can stay still. When the weight plates 804 rotate on the barbell 560 (which they can do sometimes through exercise movements), the piston disk 120 can absorb the shock from the weight plates 804 without transferring any rotational force to the body collar 110 and the contact patches 150*a*-150*c*.

FIG. 8 shows a pictorial illustration showing an example of the barbell collar 100 positioned one either side of the central area of the barbell 560. FIG. 8 shows one barbell collar 100 positioned ahead of the set of weight plates 804*a*-804*d* on the right side of the barbell 560, but it is also assumed that another barbell collar 100 is positioned ahead of the other set of weight plates 804 on the opposite side of the barbell 560. As shown in FIG. 8, there is still some room and a distance 830 from the terminal end of one side of the barbell 560 to the barbell collar 100 and the location of the first weight plate 804*a*. In one non-limiting embodiment, the user 802 first loads all the weight plates 804 on a side of the barbell 560 and then slides the barbell collar 100 over the barbell 560 with the front side 103 leading first and making contact with the first weight plate 804*a* and the back side 105 closest to the terminal end of the barbell 560. However, advantageously, this is not the only way that the barbell collar 100 may be used. Rather, when the user 802 desires to load the barbell 560 with as many weight plates 804 as desired, the user 802 can turn the barbell collar 100 so that the back surface 105 contacts the first weight plate 804*a* and the front surface 103 is closest to the terminal end of the barbell 560.

Figure 9:
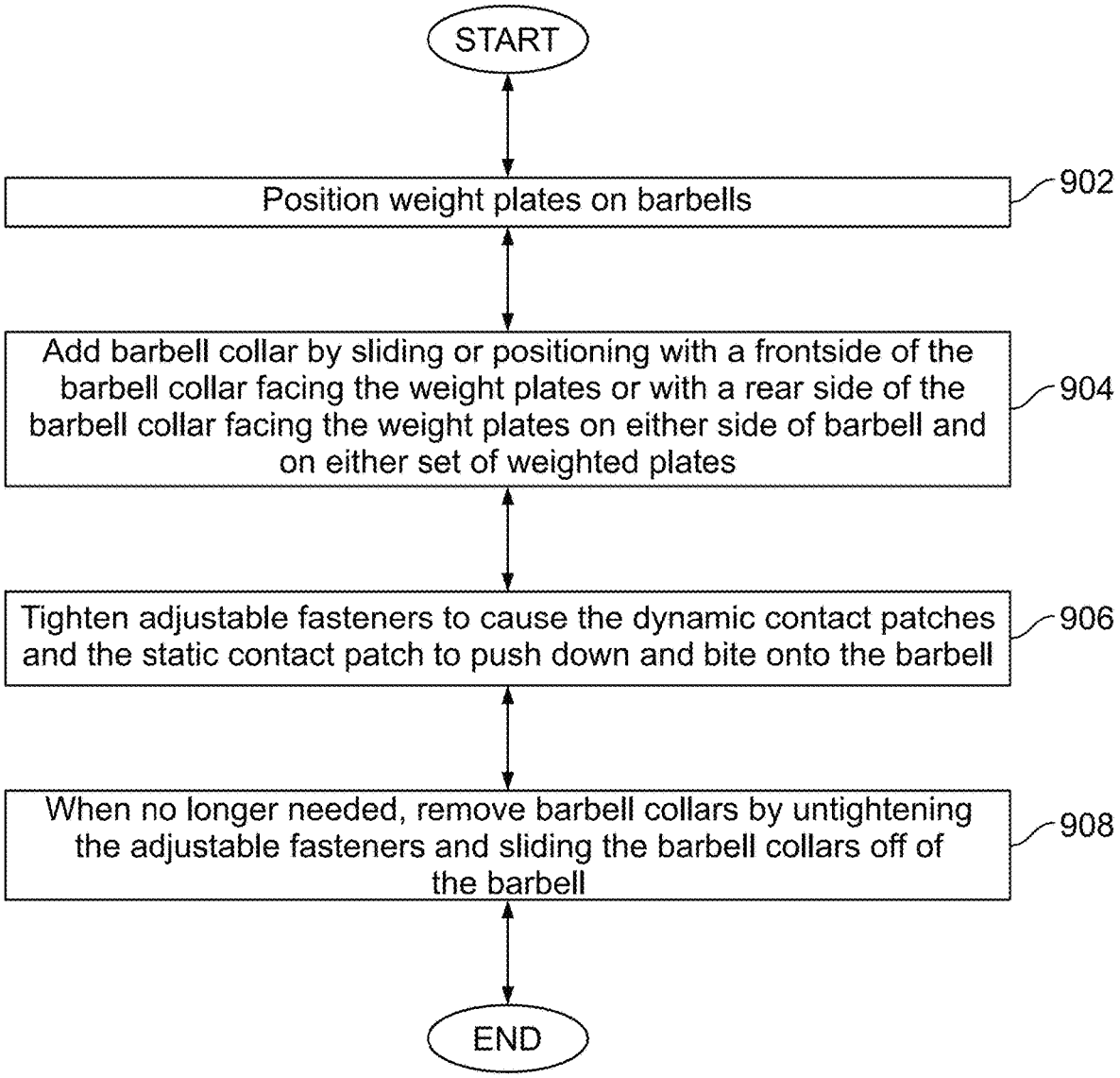
FIG. 9 is a flowchart of an exemplary method of use of the barbell collar.

FIG. 9 describes an exemplary method of using the barbell collar 100. In a non-limiting embodiment, as shown in step 902, the user 802 may first select a barbell 560 and slide or position weight plates 804 (as many as desired) on the barbell 560. At step 904, the user 802 may add one or more barbell collars 100 by sliding the barbell collars 100 with either the front side 103 of the barbell collar 100 facing the weight plates 804 or the rear side 105 of the barbell collar 100 facing the weight plates 804 on either side of the barbell 560 and on either side of the weight plates 804.

At step 906, the user 802 may tighten the adjustable fasteners 140 to cause the dynamic contact patches 150*a*, 150*b* to push down and bite or clamp down onto the barbell 560 after the desired number of weight plates 804 have been slid onto the barbell 560 by the user 802. In a non-limiting embodiment, the user 802 may hand tighten the handles 160 of the fasteners 140 to cause the dynamic contact patches 150*a*, 150*b* to bite down onto the barbell 560 held within the interior 203 of the body collar 110 and also through the cavity of the piston disk 120. At step 908, when the user 802 no longer needs the barbell collars 100 to stay tightened and in position on the barbell 560 over either side of the weight plates 804, the user 802 can remove the barbell collars 100 by loosening and untightening the adjustable fasteners 140 and then slide the barbell collars 100 off of the barbell 560. Usefully, the barbell collar 100 may be put onto the barbell 560 either the correct, conventional way as shown in FIG. 8 or may be put on backwards such that the back surface 105 faces the weight plate 804 rather than the front surface 103 of the barbell collar 100. The user 802 is able to flip the barbell collar 100 over so the contact patches 150*a*-150*c* are gripping the barbell 560 which would allow the user 802 to still utilize the barbell collar 100 even if the user 802 only has approximately half an inch of distance 830 from the end of the barbell 560 to the closest weight plate 804*a* and very little room for barbell collar 100 engagement with the barbell 560. This is a significant advantage over existing barbell collars because athletes who want to work with very loaded barbells 560 and who want to push the limit of how many weight plates 804 can be loaded onto the barbell 560 may need this feature of being able to flip over the barbell collar 100 and still have the barbell collar 100 able to hold and bite down onto the barbell 560 with a reduced amount of distance on the barbell 560 to bite down onto.

In a non-limiting embodiment, the barbell collar 100 may be one pound or 0.45 kilogram and may be able to hold at least 2000 pounds of weight plates 804 in one or more non-limiting embodiments. Tests have shown that the barbell collar 100 may be able to hold about 2500 pounds of weight plates 804.

In other non-limiting embodiments, the barbell collars 100 can be scaled to a larger size. Advantageously, the barbell collars 100 can be scaled to weigh, for example, 2.5 kilograms or 5.5 pounds. The barbell collars 100 may be made aluminum or steel or another sturdy metal that can handle the weight of the weight plates 804. In other embodiments, the barbell collar 100 may be made of another material other than metal and/or in combination with other materials.

Notably, the barbell collar 100 can be used with a variety of exercise barbells 560 including curl barbells and loadable dumbbells. Another advantage is that the barbell collar 100 can be used with Olympic barbells. Olympic barbells have a sleeve diameter of 50 mm or 1.96 inches. However, there are also Strongman barbells which have a different shaft diameter than the Olympic barbells. Axle bars are meant to be used with Strongman sports and are made of special tubing that are 1.9 inches in diameter or 48.26 mm. Usefully and advantageously, the barbell collar 100 is designed such that the barbell collar 100 can be used with either the Olympic barbells or the Axle (Strongman) bar because the dynamic contact patches 150*a*, 150*b* expand and retract enough to clamp down onto either the 50 mm (Olympic Barbell) or the 48.26 mm (Axle Barbell). This is an advantage over existing conventional barbell collars, because the user would be forced to purchase multiple types of barbell collars that can fit either the shaft diameter of the Olympic barbell or the shaft diameter of the Axle barbells, as the conventional barbell collars were not interchangeable. It is noted that the barbell 560 is a standard barbell that has not had modifications made to the barbell 560 in order for the barbell collar 100 and its respective components to fit onto the barbell 560. Rather, the barbell collar 100 is mechanically adept and designed to fit onto each end of the barbell 560 without changes to the barbell 560 form or structure. Thus, the barbell 560 does not have to be customized to fit the barbell collar 100. Rather, the barbell collar 100 can fit onto each standard barbell 560 as noted above which may be either 50 mm or the 48.26 mm in nominal diameter.

In a non-limiting embodiment, the interior diameter for an exemplary barbell collar 110 may be 2.05 inches in diameter when the dynamic contact patches 150*a*, 150*b* are in their open positions and the static contact patch 150*c* is in place. When the dynamic contact patches 150*a*, 150*b* are in their closed position, the dynamic contact patches 150*a*, 150*b* may close down to 1.83 inches. The Olympic barbell is right around 2 inches in diameter and the Axle barbell is at 1.9 inches in diameter.

Advantageously, the barbell collars 100 as described herein is lightweight and may weigh approximately one pound in total in a non-limiting embodiment, but are able to hold a great deal of weight (i.e., in the form of load provided from the weight plates 804 as shown in FIG. 8). For example, in one or more non-limiting embodiments, the barbell collars 100 may be able to hold at least 2000 lbs. of weight, which is very desirable to lifters who need a barbell collar 100 capable of securely holding a number of weight plates 804 simultaneously on a barbell 560 (e.g., as shown in FIG. 8).

The barbell collar 100, as described above, in one or more non-limiting embodiments includes a number of advantages and features that are superior to the existing, conventional barbell collars. A first advantage includes that the barbell collar 100 may absorb shock and vibration for any kind of lifting. For example, even if a user 802, as shown in FIG. 8, performs a lift in which the user 802 quickly raises a heavily weighted barbell 560 over the user 802's head and then suddenly drops the barbell 560 to the ground without a great deal of control, the barbell 560 can handle that sudden drop of the barbell 560 to the ground or floor while still holding the weight plates 804 without failing, buckling, or the barbell collar 100 falling off and losing grip of the barbell 560.

Another advantage of the barbell collar 100 is that the barbell collar 100 is serviceable unlike the existing barbell collars. The contact patches 150*a*, 150*b*, and 150*c* are the components of the barbell 100 that may wear out with time and use for multiple rounds of lifting. Advantageously, the contact patches 150*a*, 150*b*, and 150*c* are serviceable and replaceable. Accordingly, the user 802 can remove the retention ring 190 shown in FIG. 1 with any sort of tool (e.g., screwdriver). The retention ring 190 may be held against the back of the body collar 110 by friction fit and is removable. Next, the user 802 may remove the existing contact patches 150*a*, 150*b*, and 150*c* and replace with newer contact patches 150 when the old contact patches 150*a*-150*c* have worn out. With existing barbell collars, when the existing barbell collars fail or wear out, the user 802 has to buy entirely new barbell collars. However, with the barbell collar 100 shown in FIGS. 1-8 and specifically FIG. 4, the user 802 can service the barbell collar 100 by replacing one or more old or worn contact patches 150*a*-150*c*.

Advantageously, the barbell collars 100 are very strong and durable. In a non-limiting embodiment, many of the components of the barbell collar 100 may be made of steel, although this is non-limiting and other materials may be used. Notably, the energizers 130*a*-130*b* may be made of a spring like, lighter weight metal and/or rubber or another material.

It may be preferable that the barbell collars 100 are lightweight and not too heavy to carry in a user 802's bags or other storage container. Additional advantages of the dynamic weight plate retention collar include the ability to mitigate and reduce torsional friction and forces from the weight plates 804 away from the barbell sleeve 560 through the rotational degree of freedom provided by the piston disk 120. Further, the dynamic weight plate retention collar comprises of a vibration and impact absorbing mechanism using an energized component that mitigates vibration and impact through one or multitude of engineering principals including, but not limited to, springs, friction, inertia, poisons ration, viscosity, pressure, and electromagnetism. Further, the dynamic weight plate retention collar 100 includes components that remove the torsional loading requirements of the axial rotational degree of freedom along the barbell sleeve from the barbell anchor point to the weight plates.

In addition to the above, the barbell collar or dynamic weight plate retention collar 100 is configured to securely engage a single or multitude of weight plates 804 through repetitive movements that propagate high levels of vibration and impact to the barbell collar 100. The dynamic weight plate retention collar 100 is configured to anchors itself to the barbell 560 by transferring loads through load activated contact patches 150*a*-150*c* capable of reducing the inefficiencies of rotational friction of an adjustable rotatable fastener 140*a*-140*b* to a given barbell 560. The dynamic weight plate retention collar 100 contains a vibration and impact mitigation piston disk 120 that dynamically reduces transferred loads through the use of fundamental engineering principals such as springs, friction, inertia, poisons ratio, viscosity, pressure, and electromagnetism. Advantageously, the piston disk 120 is freely rotating so the piston disk 120 can absorb the linear and rotational loads from the weight plates 804.

Advantageously, the barbell collars 100 have a dynamic piston 120 and spring 130 system that allows the barbell collar 100 to absorb the shocks and vibration emitted from the weight plates 804 as the weight plates 804 and/or barbell 560 are dropped. This ensures the clamps/contact patches 150*a*-150*c* do not lose their grip prematurely as multiple reps are performed by the user 802.

In a non-limiting embodiment, FIGS. 10-13B illustrate a second embodiment for a barbell body collar which is shown as body collar 1002 in FIGS. 10-13B. The body collar 1002 shown in FIGS. 10-13B does not include some of the components shown in barbell collar 100 in FIGS. 1-8. Notably, the body collar 1002 shown in FIGS. 10-13B does not include a rotatable, dynamic piston disk 120 or energizers 130*a*, 130*b*. Further, FIGS. 10-13B does not include removable contact patches such as contact patches 150*a*, 150*b*, and 150*c* that are removably inserted into integrated contact pockets 204*a*-204*c*. However, the second embodiment illustrated as body collar 1002 does include non-removable and integrated contact patches 1040*a* and 1040*b* as shown in FIGS. 10-13B.

The body of the body collar 1002 may be circular shaped and/or ring shaped that includes a thicker circular portion 1104. There may be a hole or opening 1102 generally centrally located on a top surface of the body 1104 of the body collar 1002. The front side 1106 of the body collar 1002 may be smooth and flat in one or more non-limiting embodiments or may be textured in other non-limiting embodiments.

Notably, the body collar 1002 is a single unit having a single and integrated body. The body collar 1002 may have a cavity or annulus 1050 extending through the single body of the body collar 1002 which is capable of receiving and holding securely a barbell, such as barbell 560*a* or barbell 560*b* as further explained below with respect to FIG. 13A and FIG. 13B.

In a non-limiting embodiment, the same fastener set 145 utilized for the body collar 100 shown in FIG. 1 may be utilized for the body collar 1002 shown in FIGS. 10-13B. Notably, a handle 160*a*, as shown in FIG. 12A may be securely inserted into the fastener element 140*a* as shown in FIG. 12B and combined together. The fastener element 140*a* may be a set screw having a dedicated hole for receiving the handle 160*a* that operates in conjunction with the handle 160*a* to rotate downward or upward towards an outer surface of the barbell 560.

Figure 13A:
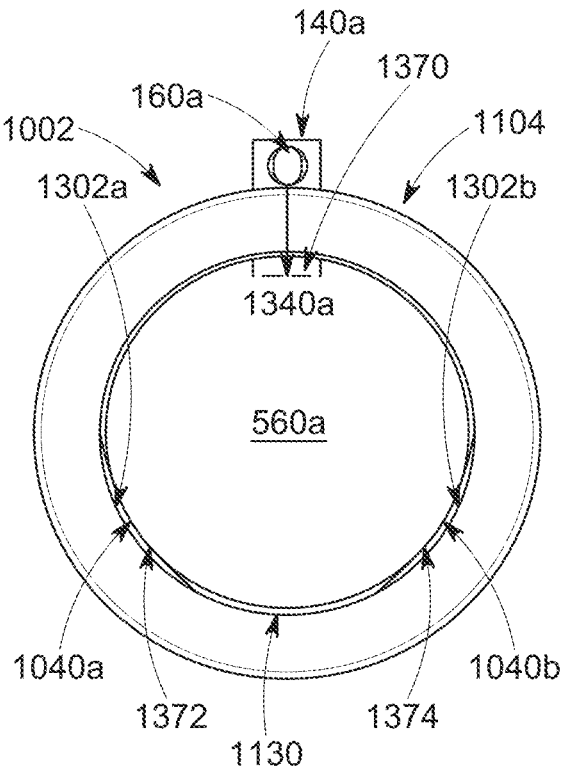
FIG. 13A is a pictorial illustration of a 50 mm barbell inserted into the cavity of the barbell collar shown in FIG. 10.
Figure 13B:
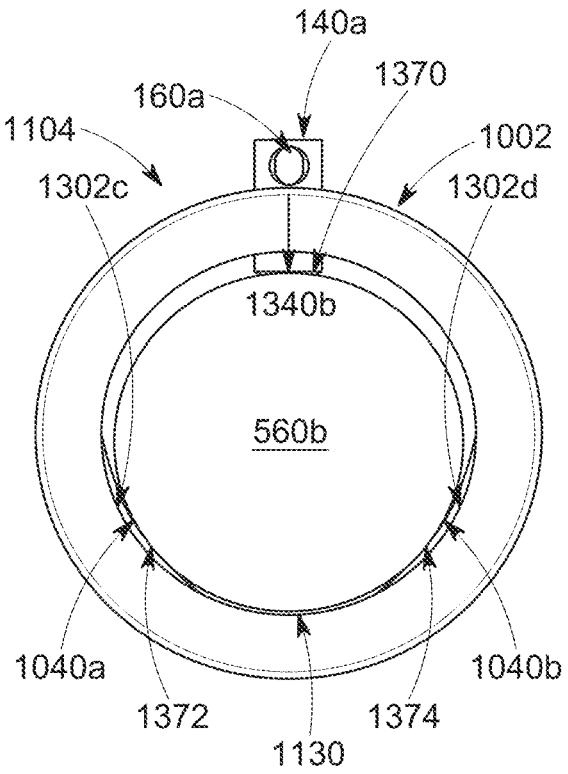
FIG. 13B is a pictorial illustration of a 1.9 inch barbell inserted into the cavity of the barbell collar shown in FIG. 10.

As known in the art, a set screw is a screw that is used to secure an object, by pressure and/or friction, within or against another object. In a non-limiting embodiment, the fastener element 140*a* is a set screw. Notably, the bottom surface of the set screw 140*a* acts as a point of contact with a top surface of a barbell 560*a*, 560*b* as shown in FIG. 13A and FIG. 13B.

Figure 10:
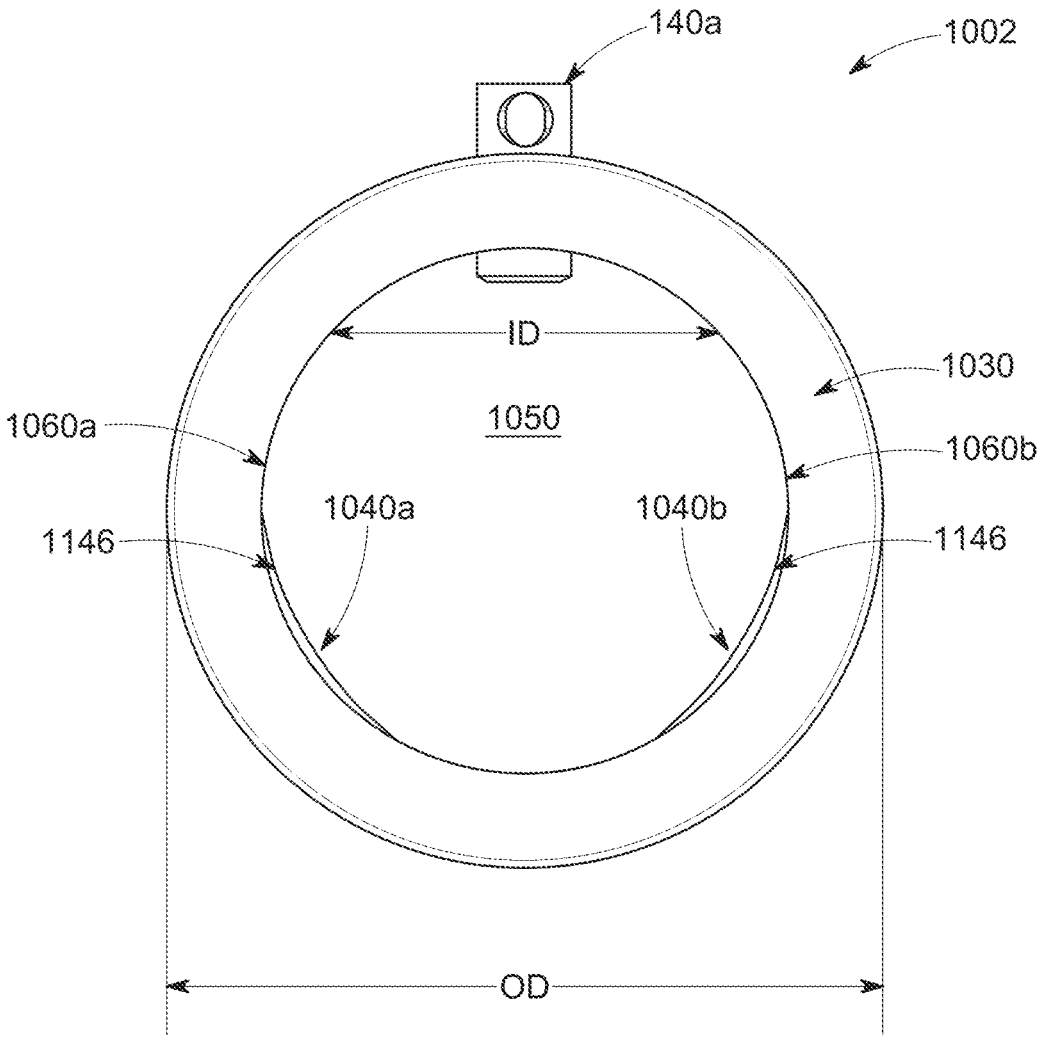
FIG. 10 is a pictorial illustration of a second embodiment of a barbell collar.
Figure 11:
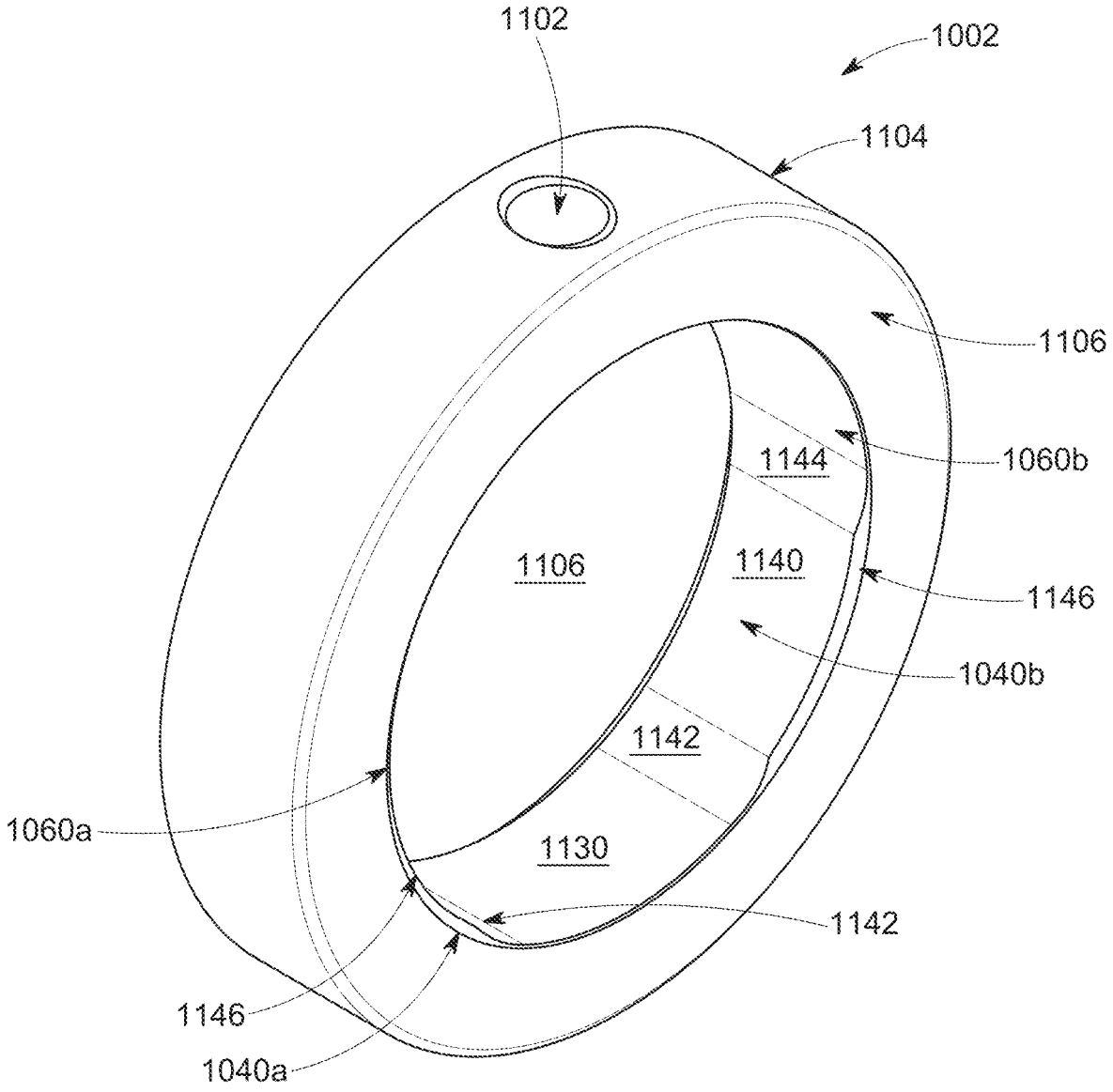
FIG. 11 is a pictorial illustration of a front perspective view of the second embodiment of a barbell collar shown in FIG. 10.
Figure 12A:
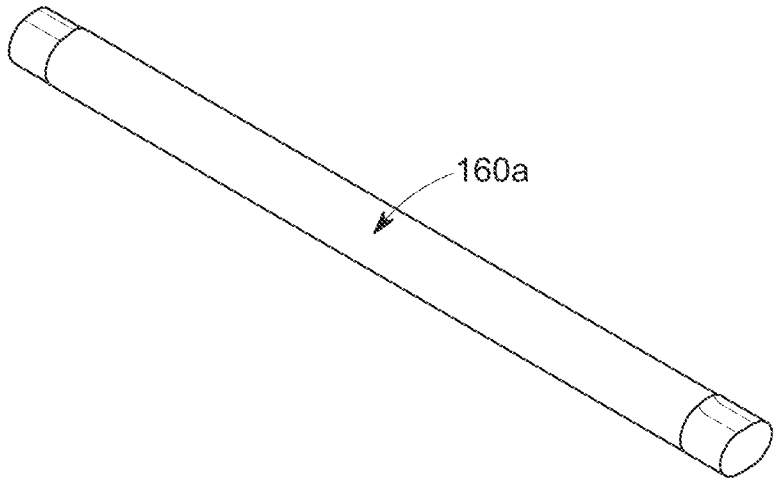
FIG. 12A is a pictorial illustration of an exemplary handle.
Figure 12B:
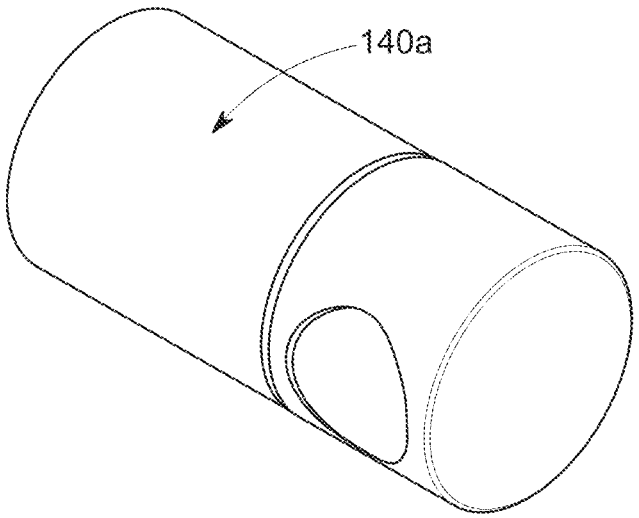
FIG. 12B is a pictorial illustration of an exemplary turnbar screw fastener.

Notably, the single unit body collar 1002 has at least two built in, integrated, and non-removable contact patches 1040*a*, 1040*b*, as shown for example in FIG. 10 and in FIG. 11. The built-in, non-removable contact patches 1040*a*, 1040*b* may be machined or otherwise formed on opposite side walls 1060 of each other within the inner perimeter of the body collar 1002 and further define the cavity 1050 of the body collar 1002.

Notably, the first non-removable contact patch 1040*a* is non-removably integrated into a first side wall 1060*a* of the body collar 1002. The second non-removable contact patch 1040*b* is non-removably integrate into a second side wall 1060*b* of the body collar 1002, as shown in FIG. 10 and in FIG. 11. In a non-limiting embodiment, the first integrated contact patch 1040*a* is positioned along a lower end of the first side wall 1060*a* and the second integrated contact patch 1040*b* is positioned along a lower end of the second side wall 1060*b* of the body collar 1002. The term "non-removable" may mean that the integrated contact patches 1040*a*, 1040*b* are permanently attached in a way that they are not easily removed or pulled off from the body of the body collar 1002 by a user or using a tool.

There may be a space or gap 1130, as shown in FIG. 11, between the first non-removable contact patch 1040*a* and the second non-removable contact patch 1040*b*. The gap 1130 may be referred to as a bar relief edge or surface. The gap 1130 or bar relief edge or surface creates the separation between first integrated contact patch 1040*a* and the second integrated contact patch 1040*b*. The gap 1130 also creates a negative space so that a given barbell 560 (e.g., 560*a* or 560*b*as shown in FIGS. 13A-13B) does not touch make contact with the interior side walls 1060 of the barbell collar 1002. Rather, the barbell 560 solely contacts the three points of contact which includes the bottom surface of the screw element 140*a*, the first integrated contact patch 1040*a*, and the second integrated contact patch 1040*b*. FIG. 13A and FIG. 13B shows that the gap or the bar relief surface 1130 prevents the barbell, whether barbell 560*a* or barbell 560*b*, from contacting the area that is the gap 1130 and the barbell 560 also does not touch the interior side walls 1060 of the barbell collar 1002.

Each contact patch 1040*a*, 1040*b* may include a portion 1146 as shown in FIG. 10 and in FIG. 11 that projects upwardly or sticks up upwardly over the interior side wall 1060 of the body collar 1002. Accordingly, the contact patch 1040*a*, 1040*b* is raised up and elevated to a certain height above the interior wall or side wall 1060 of the body collar 1002.

In a non-limiting embodiment, the contact patches 1040*a*, 1040*b* each include a first sloped portion 1142 leading up to a raised platform 1140 and a second sloped portion 1144 leading away from the raised platform 1140. The raised platform 1140 of each contact patch 1040*a*, 1040*b* may be curved or flat in one or more non-limiting embodiments. Alternatively said, the raised platform 1140 of each contact patch 1040*a* may be concave or convex shaped.

The first sloped portion 1142 and the second sloped portion 1144 of each integrated contact patch 1040*a*, 1040*b* acts as a transition edge. These transition edges 1142, 1144 may act as a transitioning surface or piece from the interior side walls 1060 of the body collar 1002 to the raised platform 1140 of each contact patch 1040*a*, 1040*b*. The transition edges 1142, 1144 may be chamfered or may be radially shaped or have any other shape in a non-limiting embodiment.

In a non-limiting embodiment, the barbells 560*a*, 560*b* as shown in FIG. 13A and FIG. 13B are supported and rest on the raised platform 1140 of each integrated and static (immobile and non-dynamic) contact patch 1040*a* and 1040*b* while the transition surfaces 1142, 1144 help to raise up the outer surfaces of the barbell 560 above the side walls 1060 on the interior of the body collar 1002.

The non-removable, integrated contact patches 1040*a*, 1040*b* provide points of contact to make contact with and firmly support the outer surfaces of the barbell (e.g., barbell 560*a*, 560*b* as shown in FIG. 13A and FIG. 13B respectively). Additionally, when fastener element 140*a* is manipulated to turn downwards and advance down towards the barbell held within the center cavity 1050 of the barbell collar 1002.

The fastener element 140*a* is also another point of contact that contacts the outer surface of the barbell 560*a*, 560*b* and can help to bite down or hold the barbell 560*a*, 560*b* securely within the cavity 1040 of the body collar 1002.

The cavity 1040 may be wide enough to fit either a standard sized barbell, such as barbell 560*a*, which is shown in FIG. 13A. which may be approximately 50 mm in nominal diameter. Notably, the body collar 1002 may also accommodate and hold an Axle barbell 560*b* which is approximately 1.9 inches (or approximately 48.26 mm) in terms of the diameter size of the barbell 560*b*. Advantageously, the barbell collar 1002 can uniquely be used with at least these two types of barbells 560*a*, 560*b*, each having a difference in their known sizes or diameters.

Accordingly, the outer diameter or OD as shown in FIG. 10 of the body collar 1002 may be preferably approximately 3-3.5 inches. The inner diameter or ID as shown in FIG. 10 of the body collar 1002 may be preferably approximately 2.05 inches.

Advantageously, the body collar 1002 as shown in FIGS. 10-11 and FIGS. 13A-13B provides at least three points of contact to axially grip or secure the barbell 560 that is inserted into the cavity 1050 of the barbell collar 1002. The exemplary three points of contact are visible in FIGS. 13A-13B. The first exemplary contact point is shown as point of contact 1370 which is provided by the bottom surface of the fastener element 140*a* (e.g. screw element) which contacts a top outer surface of the barbell 560 (e.g., 560*a* or 560*b*). The second point of contact 1372 is provided by the top surface or the raised platform 1140 of the first integrated contact patch 1040*a*. The third contact point 1374 is provided by the second integrated contact patch 1040*b* and more specifically the raised platform 1140 of the second integrated contact patch 1040*b*. Advantageously, the three points of contact 1370, 1372, and 1374 form a triangular shaped force to help secure and anchor the barbell 560 in place inside the cavity 1050 of the body collar 1002. Accordingly, the combination of the single fastener via the handle 160*a* and fastener element 140*a* and the integrated contact patches 1040*a* and 1040*b* can replace other clamping devices to securely hold a set of weight plates 804 in place behind the barbell collar 1002.

It is noted that the barbell collar 1002 can be slid onto the barbell 560 in either a front facing direction from a front side of the barbell collar 1002 or the reverse side of the barbell collar 1002. Accordingly, regardless which direction the user orients the barbell collar 1002 when the user slides the barbell collar 1002 onto the barbell 560, the barbell collar 1002 is configured to securely bite down onto the barbell 560 and hold a set of weight plates 804 in place behind the barbell collar 1002 to prevent the set of weight plates 804 from sliding off or falling off either end of the barbell 560.

It is noted that in a non-limiting embodiment, the interior side walls 1060 of the body collar 1002 may be concentric and circular. In other non-limiting embodiments, the interior side walls 1060 may be irregular formed and non-concentric as long as there is a gap or bar relief edge 1130 preventing the outer surfaces of the barbell 560*a*, 560*b* from touching the side walls 1060 of the body collar 1002. Rather, the barbell 560*a*, 560*b* when inserted within the cavity 1050 of the barbell collar 1002 should preferably only contact the bottom surface of the screw element 140*a* (e.g. first point of contact 1370), and the raised platform 1140 of the first integrated contact patch 1040*a* (e.g. the second point of contact 1372), and the raised platform 1140 of the second integrated contact patch 1040*b* (e.g., the third point of contact 1374).

Notably, the barbell collar 1002 comprises the handle 160*a*, fastener element 140*a*, and the main body 1104. The barbell collar 1002 does not include removable contact patches that require tools to disassemble or additional parts to disassemble as connected to the main body 1104. The barbell body collar 1002 is designed to have the contact patches 1040*a* and 1040*b* be integrated within the inner walls 1060*b* of the body collar 1002 without having multiple pieces that are removable.

Figure 14:
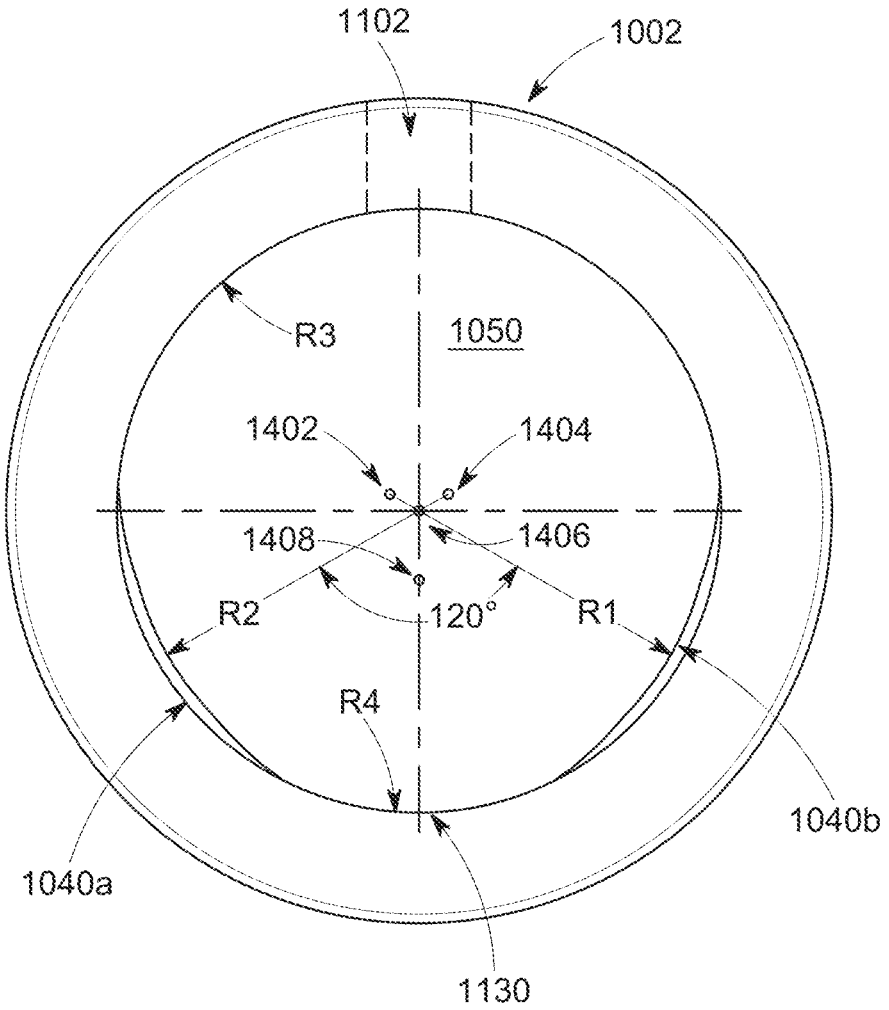
FIG. 14 is a pictorial illustration of the barbell collar with visual information related to the interior radii of the barbell collar and the contact patches.

FIG. 14 provides a visual representation of the barbell collar 1002. In a non-limiting embodiment, the first integrated contact patch 1040*a* is 120 degree apart from the second integrated contact patch 1040*b*. Further, the first integrated contact patch 1040*a* and the second integrated contact patch 1040*b* are each approximately 120 degrees apart from the fastener element 140*a* (e.g., set screw) which would be inserted into the hole 1102 as shown on the barbell collar 1002.

In a non-limiting embodiment, the first integrated contact patch 1040*a* and the second integrated contact patch 1040*b* share the same magnitude of curvature. Accordingly, a distance value of radius R1 is the same as the distance value of radius R2. However, the curvature of radius R3 (which may represent the radius of the inner diameter ID of the barbell collar 1002) may be completely independent of R1 and R2 as shown in FIG. 14. Further, the curvature of the relief or gap 1130 (which is also shown in FIG. 14 as radius R4) may be independent of R1, R2, and R3.

Notably, the center of curvature or center point for all four curvatures, R1, R2, R3, and R4, exist in different locations and are also independent of each other. FIG. 14 shows that center point 1402 is the center point for R1 which is associated with the second integrated contact patch 1040*b*. The center point 1404 coincides with the R2 for the first integrated contact patch 1040*a*. Further, the center point 1406 coincides with the R3 or inner diameter of the barbell collar 1002. Further, center point 1408 is the center point for the barbell gap or relief edge 1130. Notably, the center point R4 does not share the same position as R3 or any other curvature in a non-limiting embodiment.

In a non-limiting embodiment, the radius R1 may be approximately 1.10 inches. The radius R2 may be approximately 1.10 inches. The radius R3 may be approximately 1.03 inches, and the radius R4 may be approximately 0.89 inches.

Notably, it is beneficial that there is center point independence of R3 with respect to R1 and R2. The curvature R3 and the center point 1406 of R3 have the primary role of providing a cavity or clearance for the shaft of the barbell 560 to slide through the body 1002 during installation and removal of the barbell collar 1002.

Curvature R1 and R2 and their respective center points (e.g. 1402 and 1404) have the primary role of contacting the barbell shaft 560 and holding the shaft 560 firmly in place to prevent any sliding or movement.

Therefore, the body 1002 acts as a single static component that can accomplish two contradicting or opposing functions. The body 1002 is able to allow the barbell shaft 560 to slide through for installation of the collar 1002, as well as to grip onto the barbell 560 to prevent any sliding and movement.

For R3 to perform its function of creating a cavity 1106 that can accept and clear the barbell 560 for installation, it must have an independent center point to that of R1 and R2, which perform the opposite function of grabbing onto the barbell 560 sleeve to prevent any movement or sliding. If the center points of R3 and R1/R2 were dependent or concentric to one another the function and purpose of both R3 and R1/R2 would be compromised or less optimal.

Notably, the center point independence of R1 with respect to R2 is also beneficial. The function of both R1 and its center point 1402 and R2 and its center point 1404 is to grab onto the barbell shaft 560 that is between 50 mm in diameter to 1.9" in diameter. However, R1 and R2 have to also optimally grab onto the barbell shaft 560 simultaneously from points that are opposing at 120° or any desirable angle apart. Therefore, a single static component, which is the body of the barbell collar 1002, can grab onto any diameter varying from 50 mm to 1.9" from two points that are opposing to one another at 120° or any other desired angle.

For R1 and R2 to be able to grab onto a range of diameters from opposing sides that are 120° or any desired angle apart, the center point of R1 and R2 should preferably be independent or nonconcentric to each other. If the center point of R1 and R2 were dependent or concentric to each other, they would not be able to optimally grab onto varying diameters. Rather, they would only be able to optimally grab onto a single size or a very small range of diameters optimally. While R1 and R2 could share a dependent or concentric center point, they would not be to perform their function optimally in a wide range of barbell sleeve diameters, but rather specialize to narrow range or single size bar sleeve diameter.

Notably, the independence of the center point of R4 (i.e. 1408) with respect to the center point 1406 of R3 is also beneficial and useful. The curvature R3 and the center point 1406 of R3 have the primary role of providing a cavity/clearance for the barbell shaft 560 to slide through the body 1002 for easy installation and remove of the barbell collar 1002. The curvature R4 and its center point 1408 have the primary role of separating R1 and R2 while simultaneously providing clearance to a barbell shaft ranging from 50 mm to 1.9". R3 and its center point 1406 have the primary role of providing clearance during the installation and removal of the barbell collar 1002 onto a barbell sleeve 560, while R4 has the role of providing clearance while the barbell 560 is already tight and grabbing onto the barbell sleeve 560.

While R3 and R4 could share the same center point and still perform their function, they certainly do not have to share the same center point. Therefore, the center point of R3 and R4 are independent of each other. In fact, to allow for larger manufacturing tolerances it is preferred that R3 and R4 have independent and nonconcentric center points.

Notably, the center point 1408 of R4 is independent with respect to R1/R2 and this is beneficial to the form and function of the barbell collar 1002 as well. The curvature R4 and its center point 1408 have the primary role of separating R1 and R2 while simultaneously providing clearance to a barbell shaft ranging from 50 mm to 1.9" while the barbell collar is tight against a barbell sleeve. This is different from the primary role of R3 and the R3 center point. For R3 and its center point have the primary role of providing clearance for the installation and removal of the barbell collar 1002 onto a barbell sleeve 560, while R4 has the role of providing clearance while the barbell 560 is already tight and grabbing onto the barbell sleeve 560.

The function of both R1 (and its center point) and R2 (and its center point) is to grab onto the barbell shaft that is between 50 mm in diameter to 1.9" in diameter. However, R1 and R2 must grab onto the shaft simultaneously from points that are opposing at 120° or any desirable angle apart. Therefore, a single static component, which is the body of the barbell collar 1002, can accomplish two functions simultaneously, which is to provide clearance of the barbell sleeve at a desired location(s) and also to grip onto the barbell 560 to prevent any sliding and movement.

While R4 and R1/R2 could share the same center point and still perform their separate functions, they certainly do not have to share the same center point and still perform their functions. Therefor the center point of R4 is independent of the center point of R1/R2. In fact, to allow for a wider range of the R4 dimension, and to increase manufacturing tolerances, it is preferred that R4 and R1/R2 have independent and non concentric center points.

In a non-limiting embodiment, the barbell collar 1002 may be made of any type of metal. In another non-limiting embodiment, the barbell collar 1002 may be made of any type of material other than or in combination with metal.

Many advantages and benefits are offered by the one or more non-limiting embodiments of the barbell collar 100 and barbell collar 1002 as described herein and shown in the accompanying details.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components. The term "set" as used herein may relate to one or more item.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection. The term "set" as used herein may refer to one or more items.

Specific details are given in the description to provide a thorough understanding of the embodiments. However, embodiments may be practiced without these specific details. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, some embodiments are described as processes depicted as flow diagrams or block diagrams. Although each may describe the operations as a sequential process, many of the operations can be performed in parallel or concurrently. In addition, the order of the operations may be rearranged. A process may have additional steps not included in the figure.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus comprising:

a barbell body collar, wherein the barbell body collar comprises:

a circular body comprising a circular shaped cavity, the circular body further comprising:

a hole projecting through a top surface of the circular body;

a first integrated contact patch formed onto a first side of an interior side wall of the circular body;

a second integrated contact patch formed onto a second side of the interior side wall of the circular body, wherein the first side of the interior side wall and the second side of the interior side wall are opposite to each other, wherein an entirety of the first integrated contact patch is formed in a lower half of the circular body, and wherein the entirety of the first integrated contact patch is formed on a lower portion of the first side of the interior side wall, wherein an entirety of the second integrated contact patch is formed in a lower half of the circular body, and wherein the entirety of the second integrated contact patch is formed on a lower portion of the second side of the interior side wall, wherein the first integrated contact patch and the second integrated contact patch each comprise a raised platform that is raised a distance above the interior side wall of the circular body, and wherein the first integrated contact patch and the second integrated contact patch are separated by a gap on a lower interior surface of the circular body, wherein the gap is lower than the raised platform of the first integrated contact patch and the raised platform of the second integrated contact patch; and an adjustable fastener assembly comprising a fastener element having a handle, wherein the fastener element is insertable into the hole located through the top surface of the circular body, wherein a direction of the fastener element is manipulated by movement of the handle to move the fastener element in and out of the hole, wherein the barbell body collar comprises at least three points of contact to contact an inserted barbell that is inserted into the circular shaped cavity of the body, and wherein the at least three points of contact comprise a bottom surface of the fastener element, a top surface of the raised platform of the first integrated contact patch, and a top surface of the raised platform of the second integrated contact patch.

2. The apparatus of claim 1, wherein the fastener element is a set screw.

3. The apparatus of claim 1, wherein the first integrated contact patch and the second integrated contact patch are raised a distance above a bottom or side edge of the circular body.

4. The apparatus of claim 3, wherein the first integrated contact patch and the second integrated contact patch each comprise a first sloped transition edge leading to the raised platform that in turn leads to a second sloped transition edge.

5. The apparatus of claim 1, wherein an interior diameter of the circular body of the barbell body collar is 2.05 inches wide.

6. The apparatus of claim 1, wherein an outer diameter of the circular body of the barbell body collar is 3.0 inches wide.

* * * * *